US010756432B2

(12) United States Patent
Hill et al.

(10) Patent No.: US 10,756,432 B2
(45) Date of Patent: Aug. 25, 2020

(54) ANTENNA ELEMENT STRUCTURE SUITABLE FOR 5G CPE DEVICES

(71) Applicant: SPEEDLINK TECHNOLOGY INC., Cupertino, CA (US)

(72) Inventors: Robert Hill, Medford, OR (US); Zhanyi Qian, Suzhou (CN); Che-Chun Kuo, San Jose, CA (US); Bin Yu, Suzhou (CN)

(73) Assignees: SPEEDLINK TECHNOLOGY INC., Cupertino, CA (US); HUIZHOU SPEED WIRELESS TECHNOLOGY CO., LTD., Huizhou, Guandong (CN)

( * ) Notice: Subject to any disclaimer, the term of this patent is extended or adjusted under 35 U.S.C. 154(b) by 114 days.

(21) Appl. No.: 15/895,899

(22) Filed: Feb. 13, 2018

(65) Prior Publication Data

US 2019/0252776 A1 Aug. 15, 2019

(51) Int. Cl.

| | |
|---|---|
| ***H01Q 5/25*** | (2015.01) |
| ***H01Q 5/364*** | (2015.01) |
| ***H01Q 21/06*** | (2006.01) |
| ***H01Q 25/04*** | (2006.01) |
| *H01Q 21/00* | (2006.01) |

(52) U.S. Cl.

CPC ..... *H01Q 5/25* (2015.01); *H01Q 5/364* (2015.01); *H01Q 21/062* (2013.01); *H01Q 25/04* (2013.01); *H01Q 21/0025* (2013.01)

(58) Field of Classification Search

CPC ..... H01Q 5/25; H01Q 5/364; H01Q 21/062; H01Q 25/04

USPC ..... 343/793

See application file for complete search history.

(56) References Cited

U.S. PATENT DOCUMENTS

| | | | | |
|---|---|---|---|---|
| 2004/0027291 | A1* | 2/2004 | Zhang | H01Q 9/0442 343/700 MS |
| 2010/0177012 | A1* | 7/2010 | Morrow | H01Q 21/0025 343/893 |
| 2014/0097986 | A1* | 4/2014 | Xue | H01Q 3/34 342/372 |
| 2015/0042513 | A1* | 2/2015 | Foo | H01Q 1/246 342/368 |
| 2015/0214617 | A1* | 7/2015 | Shang | H01Q 1/246 343/722 |
| 2015/0380848 | A1* | 12/2015 | Kato | H05K 1/147 439/67 |

(Continued)

*Primary Examiner* — Huedung X Mancuso

(74) *Attorney, Agent, or Firm* — Womble Bond Dickinson (US) LLP

(57) ABSTRACT

An RF antenna includes a first substrate having a first top surface and a first bottom surface and a second substrate having a second top surface and a second bottom surface, wherein the first substrate is disposed on top of the second substrate, the second bottom surface including a ground plane disposed thereon. The RF antenna further includes a low-band (LB) radiation element disposed on the first top surface of the first substrate. The LB radiation element is to resonate within a first frequency band to transmit and receive RF signals associated with the first frequency band. The RF antenna further includes multiple high-band (HB) radiation elements disposed between the first bottom surface of the first substrate and the second top surface of the second substrate. Each HB radiation element is to resonate within a second frequency band to transmit and receive RF signals associated with the second frequency band.

18 Claims, 22 Drawing Sheets

(56) References Cited

U.S. PATENT DOCUMENTS

| | | | | |
|---|---|---|---|---|
| 2016/0190697 | A1* | 6/2016 | Preradovic | H01Q 9/0428 343/700 MS |
| 2016/0365642 | A1* | 12/2016 | Diaz | H01Q 7/06 |
| 2018/0076531 | A1* | 3/2018 | Polehn | H01Q 15/0086 |
| 2019/0081414 | A1* | 3/2019 | Kao | H01Q 21/064 |
| 2019/0089057 | A1* | 3/2019 | Mitchell | H01Q 5/35 |
| 2019/0221934 | A1* | 7/2019 | Wang | H01Q 5/30 |

* cited by examiner

ANTENNA ELEMENT STRUCTURE SUITABLE FOR 5G CPE DEVICES

FIELD OF THE INVENTION

Embodiments of the present invention relate generally to radio frequency (RF) antennas. More particularly, embodiments of the invention relate to RF antennas suitable for 5G CPE devices.

BACKGROUND

Facing to human's information society in the future of 2020, related technology of 5G (fifth generation) has not reached a stable standard, but the basic features of 5G are clear, such as high speed, low latency, mass devices connection, low power consumption. 5G terminal antenna is the main component of 5G terminals. Unless we innovatively defeat the technology difficulty of antenna design can we ensure a normal run and commercial use of 5G system. So this invention plays a positive and vital role in boosting and promoting the development of the new generation of mobile communication system and 5G terminals.

Recently, the international telecommunication union (ITU) announced the following spectrum for 5G communications, including the 24.25-27.5 GHz, 37-40.5 GHz, 66-76 GHz in millimeter wave bands, and the Federal Communications Commission (FCC) has announced the spectrum of 27.5-28.35 GHz, 37-38.6 GHz, 38.6-40 GHz, 64-71 GHz for 5G. For China, Ministry of Industry and Information Technology (MITT) announced its 5G bands, including 24.75-27.5 GHz and 37-42.5 GHz, Since all of the above bands are included by 24-43 GHz in low band and 59-71 GHz in high band, a novel antenna element which can cover all these bands is desirable.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Figure 1:
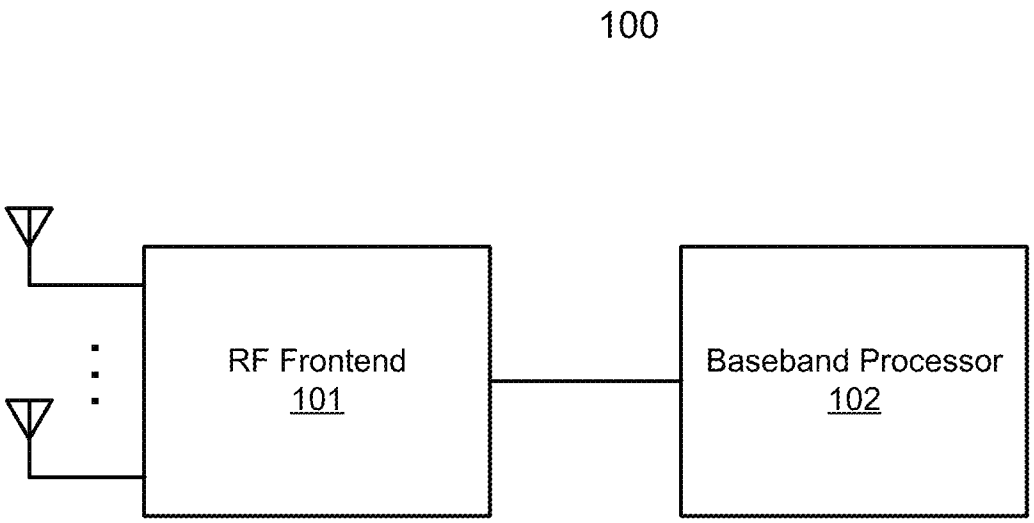
FIG. 1 is a block diagram illustrating an example of a wireless communication device according one embodiment of the invention.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

In order to solve the above technical problems, this disclosure proposes a novel antenna structure suitable for 5G CPE (customer premises equipment) application. A novel antenna element for a 5G CPE application contains a multilayer PCB (printed circuit board) substrate and two kinds of radiation element. The radiation element includes a low band direct feed magneto-electric dipole and at least four high band coupling feed magneto-electric dipoles. The four high band magneto-electric dipoles are put around the low band magneto-electric dipole, which construct the "4+1" antenna structure. The low band magneto-electric dipole contains two "T" shaped electric dipole conductive parts and a magnetic dipole composed of a pair of metal vias array, the feed structure is a metal via between this metal vias array and connect the electric dipole conductive part directly. The high band magneto-electric dipole contains a rectangular electric dipole conductive part, a "U" shaped electric dipole conductive part and a magnetic dipole composed of a pair of metal via array, the feed structure is a metal via on one side of the metal vias array and is connected to the "T" shaped conductive part as a coupling feed structure to feed the high band magneto-electric dipole antenna.

Considering of a moderate sweeping angle for the phased array application, the spacing between the high band magneto-electric dipole is set about half-wavelength, and the low band magneto-electric dipole is surrounded by the four high band magneto-electric dipoles in equal distance. However, if a higher gain value is needed, the spacing between the high band magneto-electric dipole should be larger than half wavelength.

The magneto-electric dipole antenna structure of the present invention has the advantages of simple structure, wide bandwidth, high gain, and can be easily integrated on the PCB. It can cover all of the 5G alternative frequency bands planned by many countries, and is very suitable for the 5G communication system, especially for the CPE application in millimeter wave frequency band.

According to one aspect of the invention, an RF antenna includes a first substrate having a first top surface and a first bottom surface and a second substrate having a second top surface and a second bottom surface, wherein the first substrate is disposed on top of the second substrate, the second bottom surface including a ground plane disposed thereon. The RF antenna further includes a low-band (LB) radiation element disposed on the first top surface of the first substrate. The LB radiation element is to resonate within a first frequency band to transmit and receive RF signals associated with the first frequency band. The RF antenna further includes multiple high-band (HB) radiation elements disposed between the first bottom surface of the first substrate and the second top surface of the second substrate. Each HB radiation element is to resonate within a second frequency band to transmit and receive RF signals associated with the second frequency band.

According to another aspect of the invention, an RF frontend circuit includes one or more transceivers to transmit and receive RF signals in multiple frequency bands, and one or more RF antennas coupled to the one or more transceivers. Each RF antenna includes a first substrate having a first top surface and a first bottom surface and a second substrate having a second top surface and a second bottom surface, wherein the first substrate is disposed on top of the second substrate, the second bottom surface including a ground plane disposed thereon. The RF antenna further includes a low-band (LB) radiation element disposed on the first top surface of the first substrate. The LB radiation element is to resonate within a first frequency band to transmit and receive RF signals associated with the first frequency band. The RF antenna further includes multiple high-band (HB) radiation elements disposed between the first bottom surface of the first substrate and the second top surface of the second substrate. Each HB radiation element is to resonate within a second frequency band to transmit and receive RF signals associated with the second frequency band.

FIG. 1 is a block diagram illustrating an example of a wireless communication device according one embodiment of the invention. Referring to FIG. 1, wireless communication device 100 (also simply referred to as a wireless device) includes, amongst others, an RF frontend module 101 and a baseband processor 102. Wireless device 100 can be any kind of wireless communication devices such as, for example, mobile phones, laptops, tablets, network appliance devices (e.g., Internet of thing or TOT appliance devices), etc. Wireless communication device 100 may be a CPE device.

In a radio receiver circuit, the RF frontend is a generic term for all the circuitry between the antenna up to and including the mixer stage. It consists of all the components in the receiver that process the signal at the original incoming radio frequency, before it is converted to a lower intermediate frequency (IF). In microwave and satellite receivers it is often called the low-noise block (LNB) or low-noise down-converter (LND) and is often located at the antenna, so that the signal from the antenna can be transferred to the rest of the receiver at the more easily handled intermediate frequency. A baseband processor is a device (a chip or part of a chip) in a network interface that manages all the radio functions (all functions that require an antenna).

In one embodiment, RF frontend module 101 includes an array of RF transceivers, where each of the RF transceivers transmits and receives RF signals within a particular frequency band (e.g., a particular range of frequencies such as non-overlapped frequency ranges) via one of a number of RF antennas. The RF frontend integrated circuit (IC) chip further includes a full-band frequency synthesizer coupled to the RF transceivers. The full-based frequency synthesizer generates and provides a local oscillator (LO) signal to each of the RF transceivers to enable the RF transceiver to mix, modulate, and/or demodulate RF signals within a corresponding frequency band. The array of RF transceivers and the full-band frequency synthesizer may be integrated within a single IC chip as a single RF frontend IC chip or package.

Figure 2:
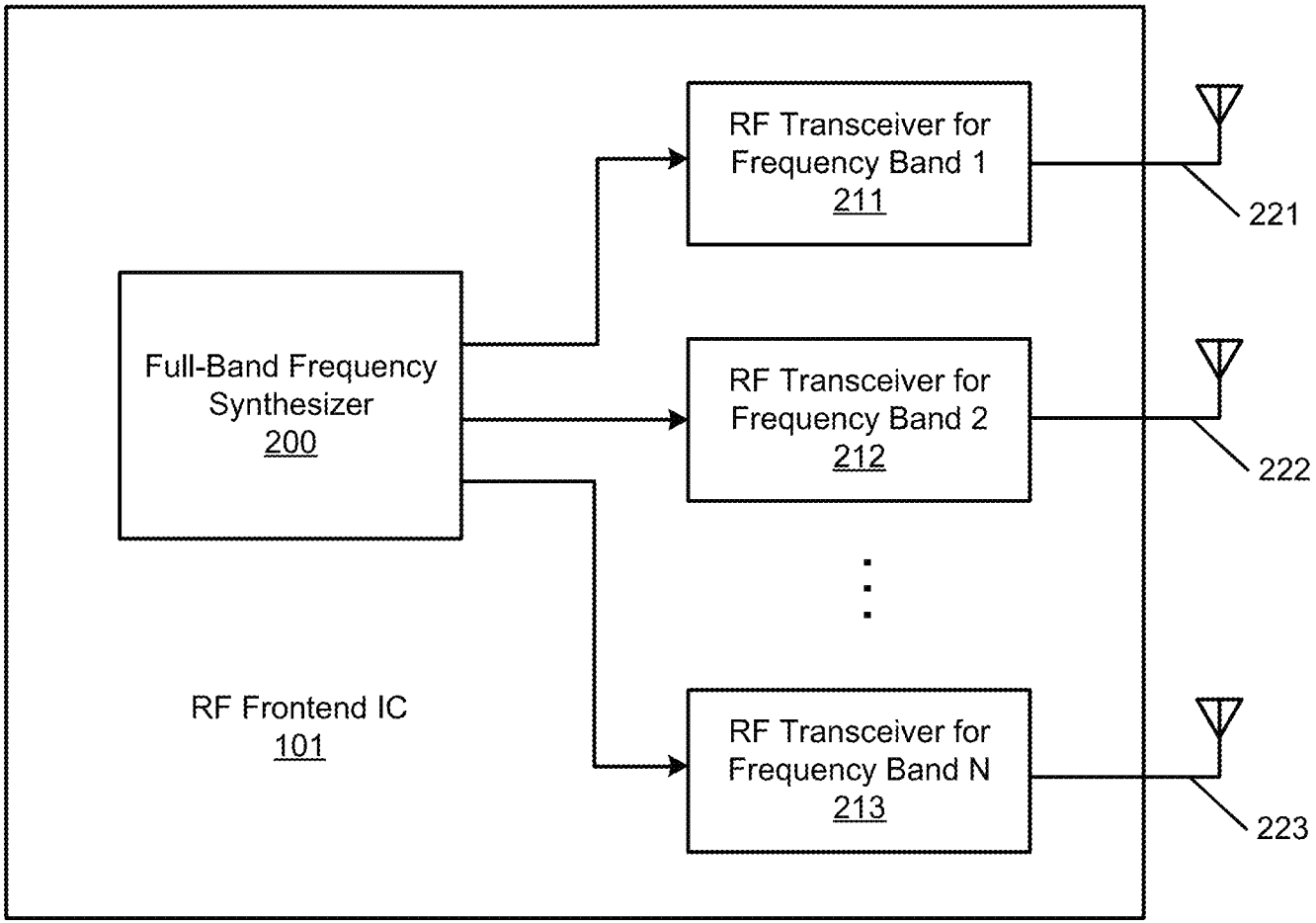
FIG. 2 is a block diagram illustrating an example of an RF frontend integrated circuit according to one embodiment of the invention.

FIG. 2 is a block diagram illustrating an example of an RF frontend integrated circuit according to one embodiment of the invention. Referring to FIG. 2, RF frontend 101 includes, amongst others, a full-base frequency synthesizer 200 coupled to an array of RF transceivers 211-213. Each of transceivers 211-213 is configured to transmit and receive RF signals within a particular frequency band or a particular range of RF frequencies via one of RF antennas 221-223. In one embodiment, each of transceivers 211-213 is configured to receive a LO signal from full-band frequency synthesizer 200. The LO signal is generated for the corresponding frequency band. The LO signal is utilized to mix, modulate, demodulated by the transceiver for the purpose of transmitting and receiving RF signals within the corresponding frequency band.

Figure 3:
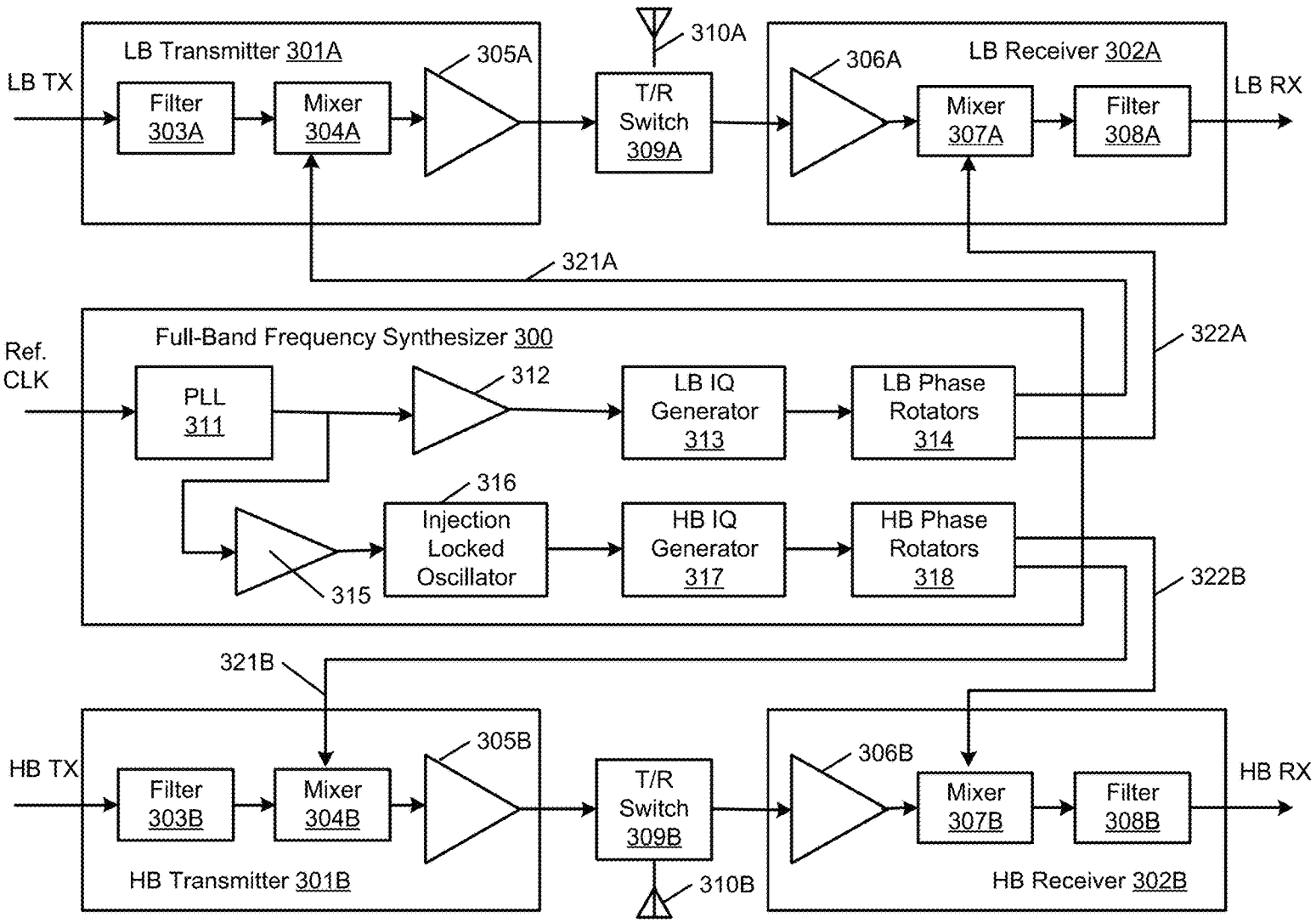
FIG. 3 is a block diagram illustrating an RF frontend integrated circuit according to another embodiment of the invention.

FIG. 3 is a block diagram illustrating an RF frontend integrated circuit according to another embodiment of the invention. Referring to FIG. 3, full-band frequency synthesizer 300 may represent full-band frequency synthesizer 101 as described above. In one embodiment, full-band frequency synthesizer 300 is communicatively coupled to an array of transceivers, each transceiver corresponding to one of a number of frequency bands. In this example, full-band frequency synthesizer 300 is coupled to transmitter 301A, receiver 302A, transmitter 301B, and receiver 302B. Transmitter 301A and receiver 302A may be a part of a first transceiver operating in a lower frequency band, referred to as a low-band (LB) transmitter and LB receiver. Transmitter 301B and receiver 302B may be a part of a second transceiver operating in a higher frequency band, referred to as a high-band (HB) transmitter and HB receiver. Note that although there are only two transceivers as shown in FIG. 3, more transceivers may also be coupled to full-band frequency synthesizer 300 as shown in FIG. 2.

In one embodiment, frequency synthesizer 300 includes, but is not limited to, phase-lock loop (PLL) circuitry or block 311, a LO buffer 312, LB in-phase/quadrature (IQ) generator 313, and LB phase rotators 314. A PLL is a control system that generates an output signal whose phase is related to the phase of an input signal. While there are several differing types, it is easy to initially visualize as an electronic circuit consisting of a variable frequency oscillator and a phase detector. The oscillator generates a periodic signal, and the phase detector compares the phase of that signal with the phase of the input periodic signal, adjusting the oscillator to keep the phases matched. Bringing the output signal back toward the input signal for comparison is called a feedback loop since the output is "fed back" toward the input forming a loop.

Keeping the input and output phase in lock step also implies keeping the input and output frequencies the same. Consequently, in addition to synchronizing signals, a phase-locked loop can track an input frequency, or it can generate a frequency that is a multiple of the input frequency. These properties are used for computer clock synchronization, demodulation, and frequency synthesis. Phase-locked loops are widely employed in radio, telecommunications, computers and other electronic applications. They can be used to demodulate a signal, recover a signal from a noisy communication channel, generate a stable frequency at multiples of an input frequency (frequency synthesis), or distribute precisely timed clock pulses in digital logic circuits such as microprocessors.

Referring back to FIG. 3, PLL block 311 is to receive a clock reference signal and to lock onto the frequency of the clock reference signal to generate a first LO signal, i.e., a low-band LO signal or LBLO signal. The first LO signal may be optionally buffered by a LO buffer 312. Based on the LBLO signal, LB IQ generator 313 generates IQ signals that are suitable for mixing, modulating, and demodulating in-phase and quadrature components of RF signals. The IQ signals may be rotated by a predetermined angle or delayed by LB phase rotators 314. The rotated IQ signals are then provided to LB transmitter 301A and receiver 302A. Particularly, the IQ signals may include transmitting IQ (TXIQ) signals 321A to be provided to LB transmitter 301A and in-phase and quadrature receiving IQ (RXIQ) signals 322A to be provided to LB receiver 302A.

In one embodiment, frequency synthesizer 300 further includes a frequency converter 315, injection locked oscillator 316, HB IQ generator 317, and HB phase rotators 318. Frequency converter 315 is to convert the first LO signal generated from the PLL block 311 to a signal with higher frequency (e.g., within a higher frequency band). In one embodiment, frequency converter 315 includes a frequency doubler to double the frequency of the first LO signal. Injection locked oscillator 316 is to lock onto the doubled-frequency signal received from frequency converter 315 to generator the second LO signal having the second LO frequency approximately twice as the first LO frequency. Note that in this example, the second LO frequency is twice as the first LO frequency. However, frequency converter 315 can convert and generate a frequency in any frequency range. If there are more frequency bands to be integrated within the RF frontend device, more frequency converters may be utilized to convert a reference frequency to a number of other lower or higher frequencies.

Injection locking and injection pulling are the frequency effects that can occur when a harmonic oscillator is disturbed by a second oscillator operating at a nearby frequency. When the coupling is strong enough and the frequencies near enough, the second oscillator can capture the first oscillator, causing it to have essentially identical frequency as the second. This is injection locking. When the second oscillator merely disturbs the first but does not capture it, the effect is called injection pulling. Injection locking and pulling effects are observed in numerous types of physical systems, however the terms are most often associated with electronic oscillators or laser resonators.

Referring back to FIG. 3, HB IQ generator 317 generates IQ signals that are suitable for mixing, modulating, and demodulating in-phase and quadrature components of RF signals in a high band frequency range. In electrical engineering, a sinusoid with angle modulation can be decomposed into, or synthesized from, two amplitude-modulated sinusoids that are offset in phase by one-quarter cycle ($\pi/2$ radians). All three functions have the same frequency. The amplitude modulated sinusoids are known as in-phase and quadrature components. Some people find it more convenient to refer to only the amplitude modulation (baseband) itself by those terms.

The IQ signals may be rotated by a predetermined angle or delayed by HB phase rotators 318. The rotated IQ signals are then provided to HB transmitter 301B and receiver 302B. Particularly, the IQ signals may include transmitting IQ (TXIQ) signals 321B to be provided to HB transmitter 301B and in-phase and quadrature receiving IQ (RXIQ) signals 322B to be provided to HB receiver 302B. Thus, components 312-314 are configured to generate TXIQ and RXIQ signals for LB transmitter 301A and LB receiver 302A, while components 315-318 are configured to generate TXIQ and RXIQ signals for HB transmitter 301B and HB receiver 302B. If there are more transmitters and receivers of more frequency bands involved, more sets of components 312-314 and/or components 315-318 may be maintained by frequency synthesizer 300 for generating the necessary TXIQ and RXIQ signals for the additional frequency bands.

In one embodiment, LB transmitter 301A includes a filter 303A, a mixer 304A, and an amplifier 305A. Filter 303A may be a low-pass (LP) filter that receives LB transmitting (LBTX) signals to be transmitted to a destination, where the LBTX signals may be provided from a baseband processor such as baseband processor 102. Mixer 301A (also referred to as an up-convert mixer or an LB up-convert mixer)) is configured to mix and modulate the LBTX signals onto a carrier frequency signal based on TXIQ signal provided by LB phase rotators 314. The modulated signals (e.g., low-band RF or LBRF signals) are then amplified by amplifier 305A and the amplified signals are then transmitted to a remote receiver via antenna 310A.

In one embodiment, LB receiver 302A includes an amplifier 306A, mixer 307A, and filter 308A. Amplifier 306A is to receive LBRF signals from a remote transmitter via antenna 310A and to amplify the received RF signals. The amplified RF signals are then demodulated by mixer 307A (also referred to as a down-convert mixer or an LB down-convert mixer) based on RXIQ signal received from LB phase rotators 314. The demodulated signals are then processed by filter 308A, which may be a low-pass filter. In one embodiment, LB transmitter 301A and LB receiver 302A share antenna 310A via a transmitting and receiving (T/R) switch 309A. T/R switch 309A is configured to switch between LB transmitter 301A and receiver 302A to couple antenna 310A to either LB transmitter 301A or LB receiver 302A at a particular point in time.

Similarly, HB transmitter 301B includes filter 303B, mixer 304B (also referred to as a HB up-convert mixer), and amplifier 305B having functionalities similar to filter 303A, mixer 304A, and amplifier 305A of LB transmitter 301A, respectively, for processing high-band transmitting (HBTX) signals. HB receiver 302B includes filter 306B, mixer 307B (also referred to as a HB down-convert mixer), and filter 308B having functionalities similar to amplifier 306A, mixer 307A, and filter 308A of LB receiver 302A, respectively, for processing high-band receiving (HBRX) signals. HB transmitter 301B and HB receiver 302B are coupled to antenna 310B via T/R switch 309B similar to the configuration of LB transmitter 301A and receiver 302A. Antenna 310A-310B may represent any one or more of antennas 221-223 of FIG. 2, which are not part of the RF frontend circuit.

Figure 4:
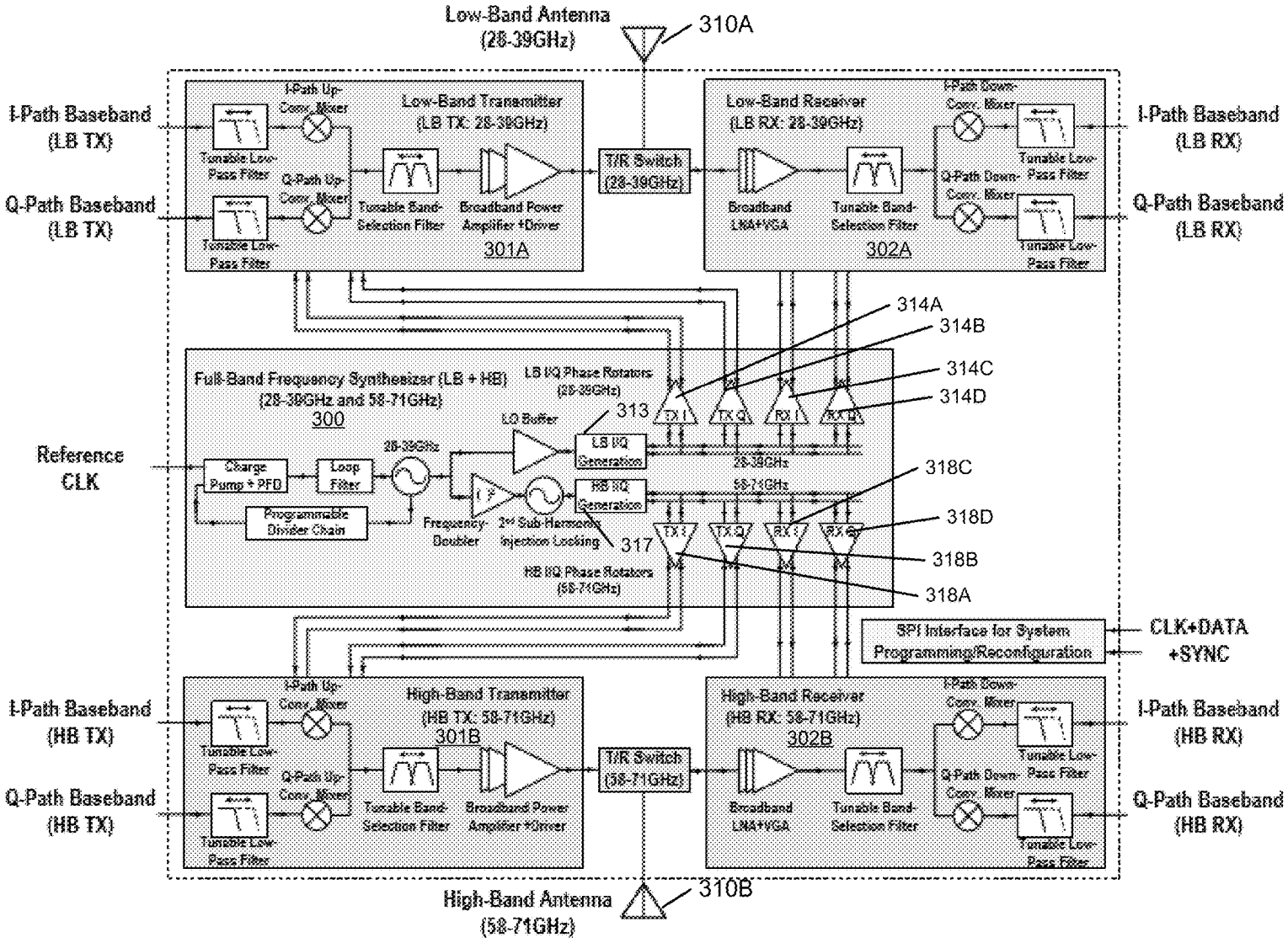
FIG. 4 is a block diagram illustrating an RF frontend integrated circuit according to another embodiment of the invention.

FIG. 4 is a block diagram illustrating an example of an RF frontend integrated circuit according to another embodiment of the invention. Referring to FIG. 4, in this embodiment, each of LB transmitter 301A, LB receiver 302A, HB transmitter 301B, and HB receiver 302B includes two paths: 1) I path for processing in-phase component signals and 2) Q-path for processing quadrature component signals. In one embodiment, LB transmitter 301A includes an I-path low-pass filter (e.g., a tunable low-pass filter) to receive I-path baseband signals and an I-path up-convert mixer to mix and modulate the I-path baseband signals. LB transmitter 301A includes a Q-path low pass filter (e.g., a tunable low-pass filter) to receive Q-path baseband signals and a Q-path up-convert mixer to mix and modulate the Q-path baseband signals. LB transmitter 301A further includes a tunable band selection filter and an amplifier. The band selection filter (e.g., a band-pass filter) is to select the corresponding frequency band to remove noises that are outside of the corresponding band. The amplifier is to amplify the modulated RF signals to be transmitted to a remote device via antenna 310A. HB transmitter 301B includes similar components as of LB transmitter 301A for processing signals in a higher frequency band.

Similarly, according to one embodiment, LB receiver 302A includes an amplifier (e.g., a low-noise amplifier or LNA) to receive LBRF signals from a remote device via antenna 310A and a band selection filter (e.g., a band-pass filter). LB receiver 302A further includes an I-path down-convert mixer and a Q-path down-convert mixer to mix and demodulate the RF signal into I-path baseband signals and Q-path baseband signals. LB receiver 302A further includes an I-path low-pass filter and a Q-path low-pass filter to processing the I-path baseband signals and the Q-path baseband signals, which can then be provided to the baseband processor. HB receiver 302B includes similar components as of LB receiver 302A for processing signals in a higher frequency band.

In one embodiment, frequency synthesizer 300 includes a PLL block having a charge pump with a phase frequency detector, a loop filter, a programmable divider, a voltage-controlled oscillator. The frequency synthesizer 300 further includes a frequency doubler and an injection locking oscillator as described above with respect to FIG. 3.

In addition, frequency synthesizer 300 includes in-phase transmitting (TXI) phase rotator 314A, quadrature transmitting (TXQ) phase rotator 314B, in-phase receiving (RXI) phase rotator 314C, and quadrature receiving (RXQ) phase rotator 314D, which are specifically configured to perform phase rotation to generate in-phase LO signals and quadrature LO signals for LB transmitter 301A and LB receiver 302A. Specifically, TXI phase rotator 314A is coupled to the I-path up-convert mixer of LB transmitter 301A and TXQ phase rotator 314B is coupled to the Q-path up-convert mixer of LB transmitter 301A to enable the I-path and Q-path baseband signals to be mixed and modulated within the corresponding frequency band. RXI phase rotator 314C is coupled to the I-path down-convert mixer of LB receiver 302A and RXQ phase rotator 314D is coupled to the Q-path down-convert mixer of LB receiver 302A to enable the I-path and Q-path baseband signals to be mixed and demodulated within the corresponding frequency band.

In one embodiment, frequency synthesizer 300 includes in-phase transmitting (TXI) phase rotator 318A, quadrature transmitting (TXQ) phase rotator 318B, in-phase receiving (RXI) phase rotator 318C, and quadrature receiving (RXQ) phase rotator 318D, which are specifically configured to perform phase rotation to generate in-phase LO signals and quadrature LO signals for HB transmitter 301B and HB receiver 302B. Specifically, TXI phase rotator 318A is coupled to the I-path up-convert mixer of HB transmitter 301B and TXQ phase rotator 318B is coupled to the Q-path up-convert mixer of HB transmitter 301B to enable the I-path and Q-path baseband signals to be mixed and modulated within the corresponding frequency band. RXI phase rotator 318C is coupled to the I-path down-convert mixer of HB receiver 302A and RXQ phase rotator 318D is coupled to the Q-path down-convert mixer of HB receiver 302B to enable the I-path and Q-path baseband signals to be mixed and demodulated within the corresponding frequency band.

Again, in this example as shown in FIG. 4, there are two frequency bands covered by the frequency synthesizer 300. However, more frequency bands may be implemented within the integrated RF frontend. If there are more frequency bands to be implemented, more sets of TXI, TXQ, RXI, and RXQ phase rotators may be required.

Figure 5A:
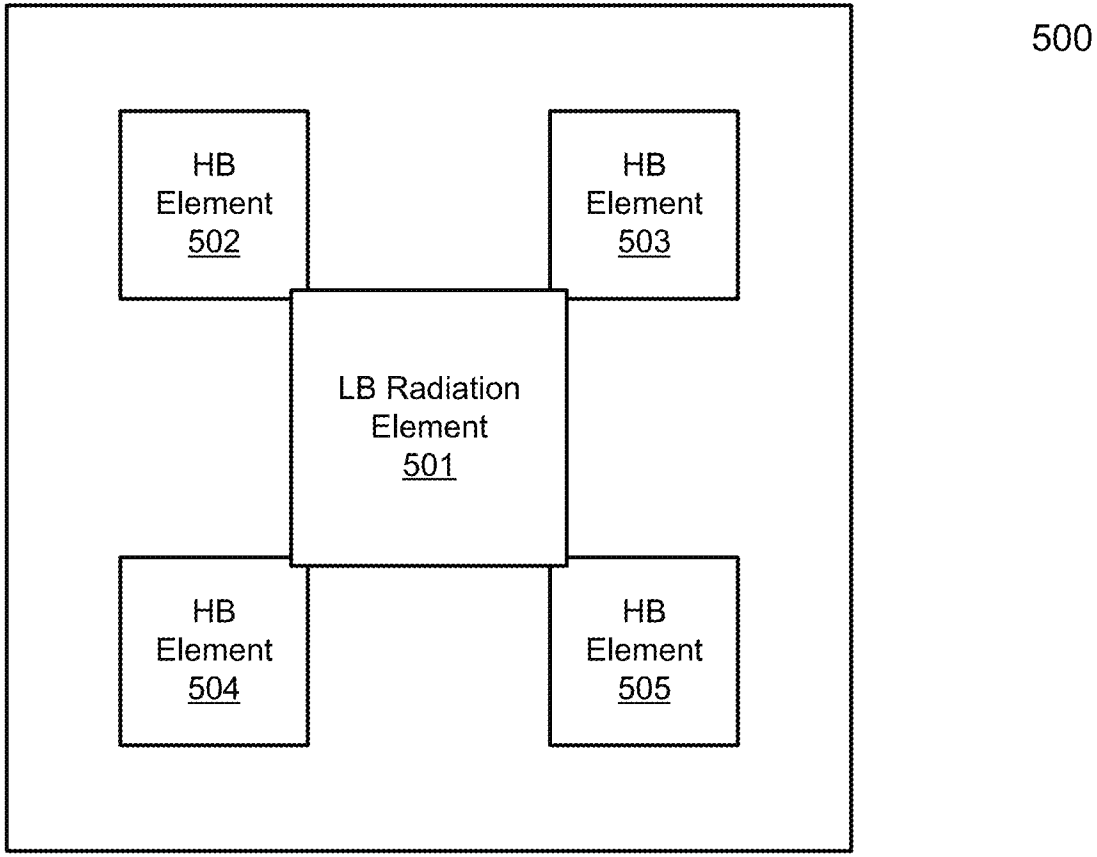
FIGS. 5A and 5B are block diagrams illustrating examples of antennas according to certain embodiments of the invention.

FIG. 5A a block diagram illustrating an example of an antenna according to one embodiment. Antenna 500 may represent any one or more of the antennas as described above, such as, for example, antennas 221-223 of FIG. 2 and antennas 310A-310B of FIG. 3. Referring to FIG. 5A, antenna 500 may be implemented as an integrated circuit such as a single die of the IC. In one embodiment, antenna 500 includes multiple HB radiation elements and an LB radiation element. Each HB radiation element is configured to resonate or excite within a first frequency band to transmit and/or receive RF signals associated with the first frequency band. The LB band radiation element is configured to resonate or excite within a second frequency band to transmit and/or receive RF signals associated with the second frequency band. A frequency band refers to a range of frequencies. In one embodiment, the first frequency band is higher in frequency than the second frequency band. The HB radiation elements are arranged such that the distance between any two of the HB radiation elements is at least a half of a wavelength associated with the first frequency band. The LB radiation element is surrounded by the HB radiation elements, for example, in a symmetrical manner.

In this example as shown in FIG. 5A, antenna 500 includes an LB radiation element 501 surrounded by HB radiation elements 502-505. Although there are four HB radiation elements 502-505 shown, more or fewer HB radiation elements can also be implemented. Each of the HB radiation elements 502-505 is configured to resonate or excite within a first frequency band to transmit and/or receive RF signals associated with the first frequency band. The LB radiation element 501 is configured to resonate or excite within a second frequency band to transmit and/or receive RF signals associated with the second frequency band.

Note that FIG. 5A shows a top view of an antenna integrated circuit. LB radiation element 501 is not directly electrically coupled to any of HB radiation elements 502-505. They may be implemented in different substrate layers of the integrated circuit. According to one embodiment, each HB radiation element includes a coupling feed magneto electric dipole structure. Each LB radiation element includes a direct feed magneto electric dipole structure.

The HB radiation elements 502-505 are arranged such that the distance between any two of the HB radiation elements 502-505 is at least a half of a wavelength associated with the first frequency band. The LB radiation element is surrounded by the HB radiation element, for example, in a symmetrical manner as shown in FIG. 5A. In one embodiment, the distance between any two nearest or adjacent HB radiation elements (e.g., between HB radiation elements 502-503, between HB radiation elements 502 and 504, between HB radiation elements 504-505, or between HB radiation elements 503 and 505) is at least a half of a first wavelength associated with the first frequency band.

In one embodiment, the first frequency band is ranging approximately from 59 GHz to 71 GHz, while the second frequency band is ranging approximately from 24 GHz to 43 GHz. A wavelength ($\lambda$) of a frequency band is determined based on a center frequency (f) of the frequency band in view of the speed of light (C): $\lambda=C/f$. For the first frequency band from 59 GHz to 71 GHz, the center frequency is approximately 65 GHz and the corresponding first wavelength is approximately 2.3 mm. For the second frequency band from 24 GHz to 43 GHz, the center frequency is approximately 33.5 GHz and its corresponding second wavelength is approximately 4.5 mm.

In one embodiment, the distance between any two nearest or adjacent HB radiation elements is ranging approximately from 2.07 mm to 2.50 mm, preferably 2.3 mm. In this example, LB radiation element 501 is symmetrically surrounded by HB radiation elements 502-505. In one embodiment, each of the HB radiation elements 502-505 and the LB radiation element 501 is in a substantially rectangular or square shape, where a square shape represents a special case of a rectangular shape.

Figure 5B:
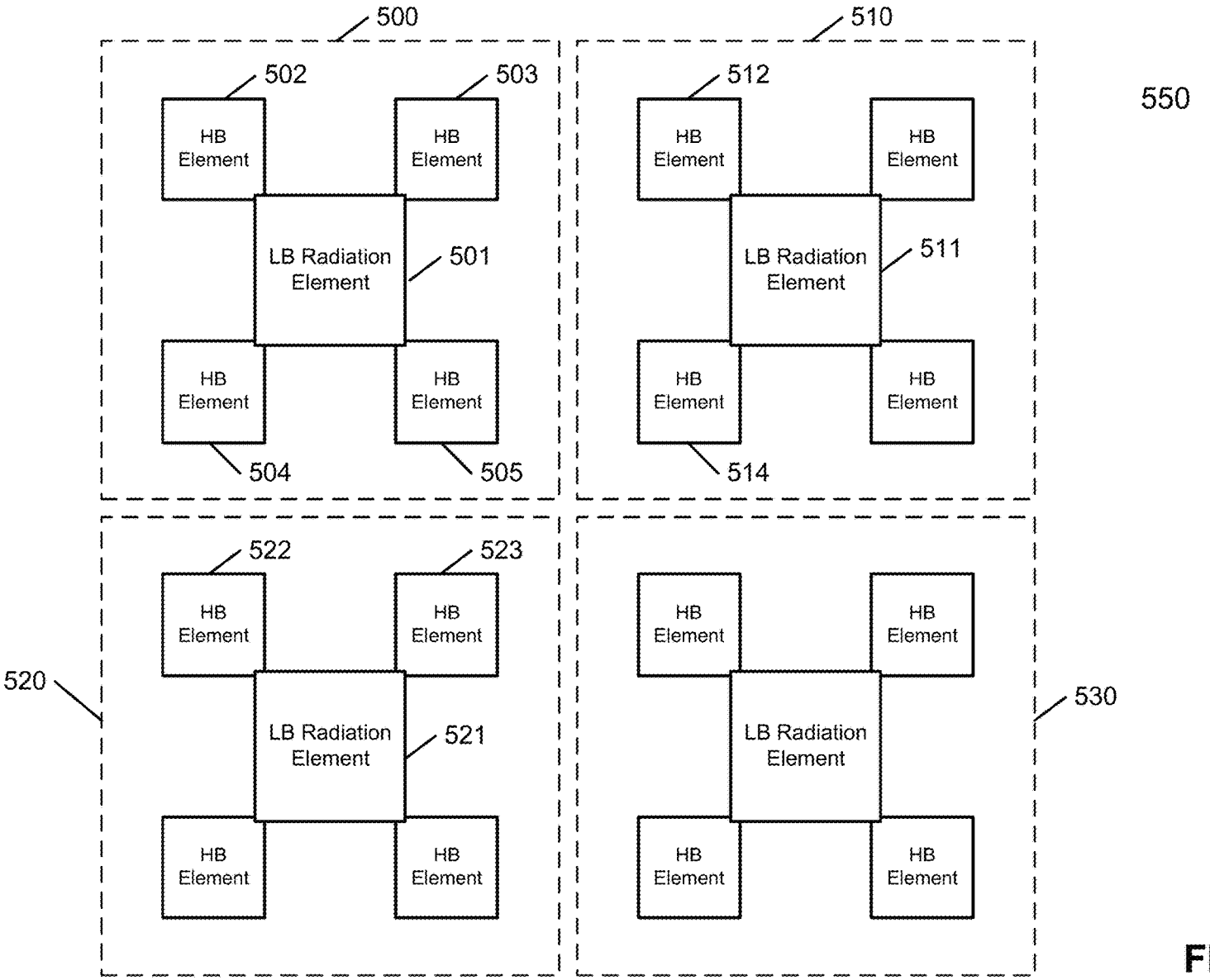

According to one embodiment, antenna 500 can be utilized one of a number of antenna units of an antenna array as shown in FIG. 5B. Referring to FIG. 5B, antenna array 550 includes a number of antenna units, in this example, antenna units 500, 510, 520, and 530. Each of antenna units 500, 510, 520, and 530 includes multiple HB radiation elements (e.g., HB radiation elements 502-505) and an LB radiation element (e.g., LB radiation element 501). The HB radiation elements of antenna array 550 are arranged such that the distance between any two of the HB radiation elements of antenna array 550 is at least a half of the first wavelength associated with the first frequency band (e.g., 2.3 mm). In one embodiment, a distance between any two nearest or adjacent HB radiation elements of antenna array 550 is approximately ranging from 2.07 mm to 2.5 mm. According to another embodiment, the distance between any two of the LB radiation elements is at least a half of the second wavelength associated with the second frequency band (e.g., 4.5 mm). In one embodiment, a distance between any two nearest or adjacent LB radiation elements of antenna array 550 is approximately ranging from 4.05 mm to 4.95 mm.

In this example as shown in FIG. 5B, the distance between HB radiation element 503 and HB radiation element 512 is ranging approximately from 2.07 mm to 2.5 mm, preferably 2.3 mm. The distance between LB radiation element 501 of antenna unit 500 and LB radiation element 511 of antenna unit 510 is ranging approximately from 4.05 mm to 4.95 mm, preferably 4.5 mm. The term of a distance between two radiation elements refers to a distance between center points of the radiation elements.

Figure 6:
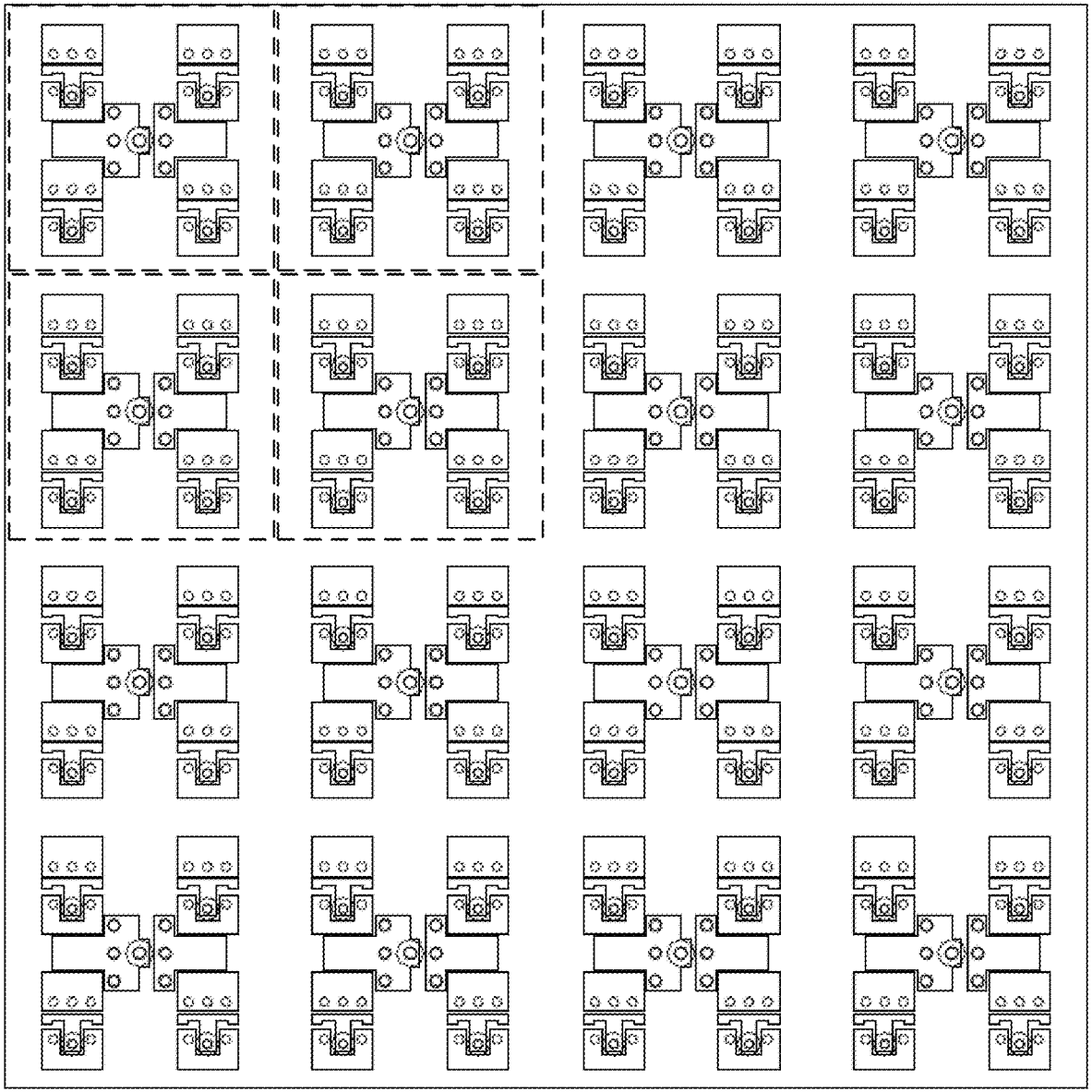
FIG. 6 is a block diagram illustrating an example of an antenna array according to one embodiment.

Although there are four antenna units as shown in FIG. 5B, the number of antenna units can be scaled up horizontally and/or vertically dependent upon the configuration, as shown in FIG. 6. When the number of antenna units increases, the distance between any two of the HB radiation elements and the distance between any two of the LB radiation elements of any antenna unit or antenna units have to satisfy the distance requirements as set forth above.

In one embodiment, in order to maintain the proper distance between two radiation elements of adjacent antenna units, the distance between each radiation element (e.g., either an HB radiation element or an LB radiation element) and an edge of the corresponding antenna unit (represented as a dash rectangular or square herein) is approximately a quarter (¼) of a wavelength of a corresponding frequency band. For example, the distance between an HB radiation element and an edge of the corresponding antenna unit is ranging approximately from 1.035 mm to 1.25 mm, preferably 1.15 mm. The distance between an LB radiation element and an edge of the corresponding antenna unit is ranging approximately from 2.025 mm to 2.475 mm, preferably 2.25 mm.

Figure 7A:
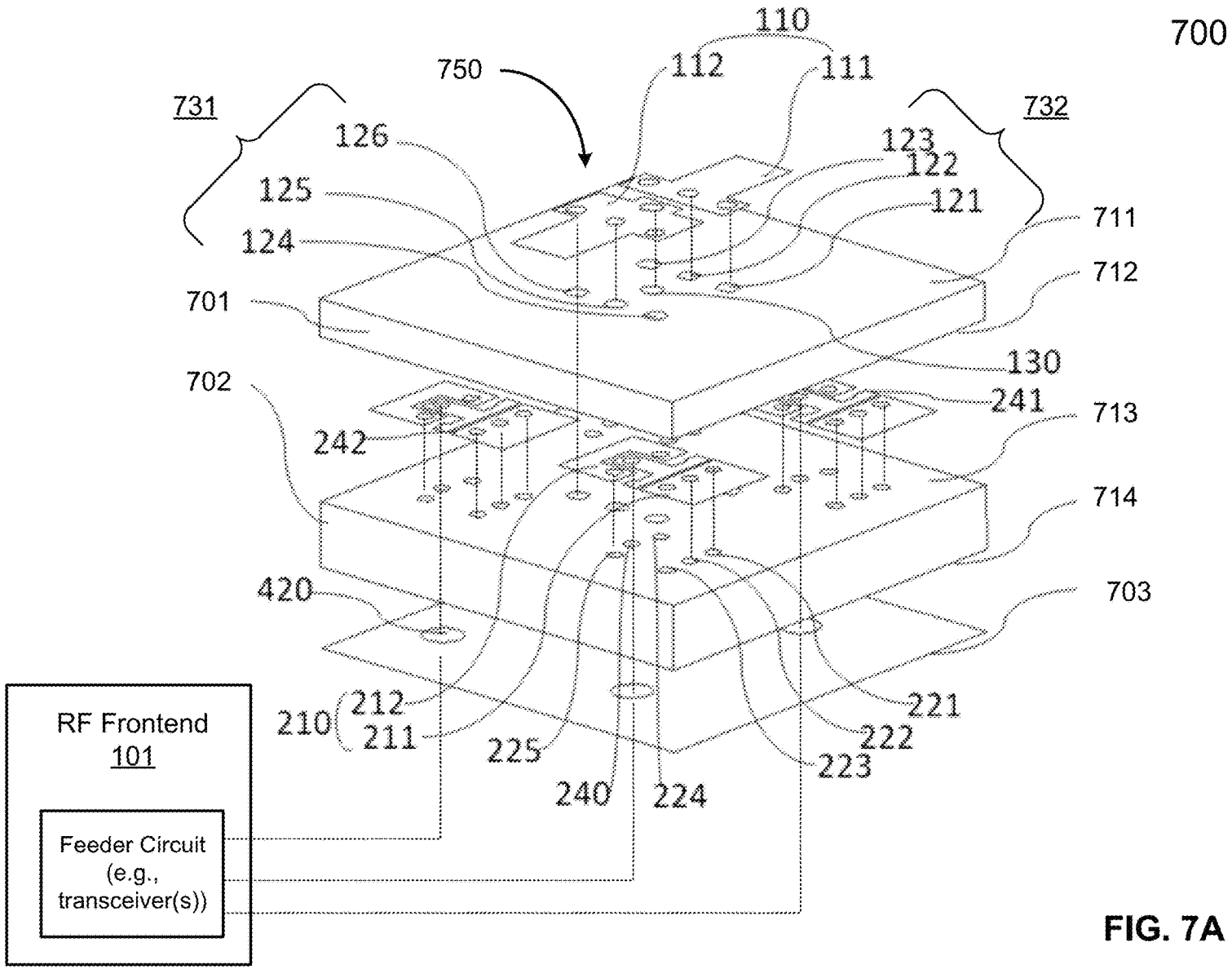
FIGS. 7A and 7B show an RF antenna structure according to one embodiment of the invention.
Figure 7B:
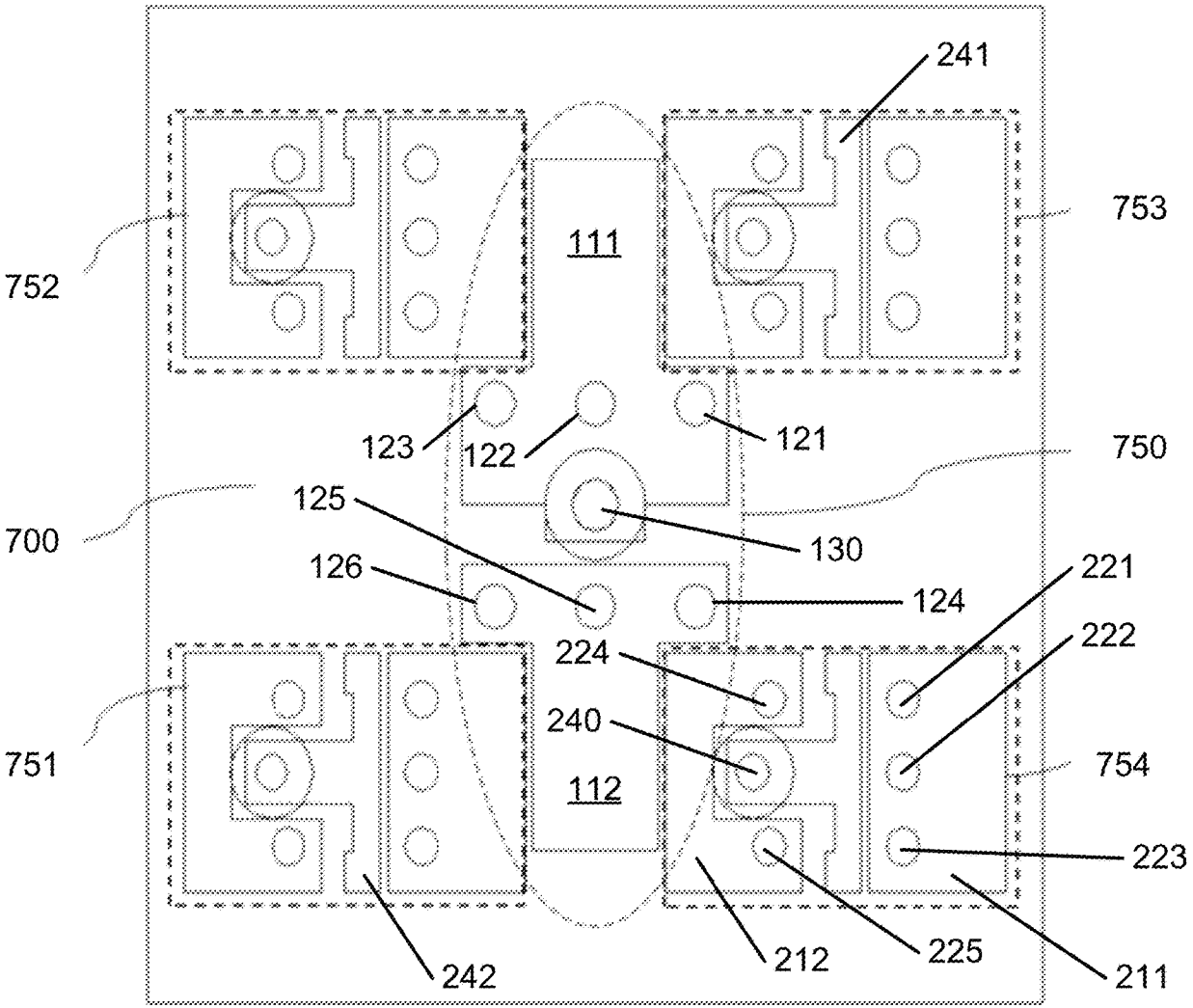

FIGS. 7A and 7B show a perspective view and a top view of an RF antenna structure in a form of an integrated circuit according to one embodiment of the invention. Antenna structure 700 may be implemented as any of the RF antennas described above, such as, for example, antenna 500 of FIG. 5A. Referring to FIGS. 7A and 7B, antenna 700 includes a first substrate 701 and a second substrate 702, where first substrate 701 is disposed on the top of second substrate 702. First substrate 701 includes a first top surface 711 and a first bottom surface 712 and second substrate 702 includes a second top surface 713 and a second bottom surface 714. A ground plane 703 is disposed on the second bottom surface 714 of second substrate 702.

In addition, according to one embodiment, antenna 700 includes a LB radiation element 750 disposed on the first top surface 711 of first substrate 701. The LB radiation element 750 includes a first electrically conductive section 112 and a second electrically conductive section 111, also simply referred to as conductive sections or conductive parts. Conductive sections 111-112 form an electrical dipole of the antenna. In one embodiment, each of conductive sections 111-112 is in a T-shape conductive element.

In addition, a first via array 731 of vias 124-126 is disposed on the first conductive section 112 and a second via array 732 of vias 121-123 is disposed on the second conductive section 111 to form a magnetic dipole 110. In one embodiment, vias 121-123 are disposed on the cross bar of the T-shape conductive section 111, while vias 124-126 are disposed on the cross bar of the T-shape conductive section 112. The via array 732 of vias 121-123 are positioned aligned in parallel with vias 124-126 of via array 731. Each of the vias 121-126 in the via arrays 731-732 is extended or drilled through the first substrate 701 and the second substrate 702 downwardly to contact with ground plane 703, which is disposed on the bottom surface 714 of second substrate 702. Vias 121-123 and 124-126 connect conductive sections 111-112 with ground plane 703 respectively.

Furthermore, a feed via 130 is also drilled through the substrates 701-702. The feed via 130 is disposed in the middle of the magnetic dipole and connects electric dipole 110 to ground plane 703. Thus signal is directly feed to the electric dipole conductive parts 111-112 through the feed via 130. Feed via 130 is disposed between via array 731 of vias 124-126 and via array 732 of vias 121-123. In this example, feed via 130 is disposed and connected with conductive section 112. However, feed via 130 can also be disposed on conductive section 111. Note that feed via 130 extends downwardly through substrates 701-702, but feed via 130 does not contact with ground plane 703. In one embodiment, there is an opening that has been cut out within which the conductive material has been removed from the ground plane 703, such as opening 420. The opening on ground plane 703 allows feed via 130 to be connected with the corresponding feeder circuit of RF frontend 101.

According to one embodiment, antenna 700 further includes multiple HB radiation elements, in this example, HB radiation elements 751-754. Although there are only four HB radiation elements shown, more or fewer HB radiation elements may be implemented. In one embodiment, HB radiation elements are positioned substantially symmetrically with respect to LB radiation element 750. In this example, LB radiation element 750 is position in a substantially central location, while HB radiation elements 751-754 are positioned symmetrically surrounding LB radiation element 750, similar to the configuration as shown in FIG. 5A. In one embodiment, each of the HB radiation elements 751-754 has a substantially the same structure.

In one embodiment, similar to LB radiation element 750, each HB radiation element includes an electrical dipole and a magnetic dipole. For example, HB radiation element 754 includes an electrical dipole formed by conductive sections 211-212. In this embodiment, conductive section 211 includes a rectangular shape conductive element, while conductive section 212 includes a U-shape conductive element. The magnetic dipole of HB radiation element 754 is formed by via array 221-223 and via array 224-225. Vias 221-223 and vias 224-225 are positioned substantially in parallel with each other. Each of vias 221-225 is extended downwardly through substrates 701-702 and contacts to reach ground plane 703.

In addition, according to one embodiment, feed via 240 is disposed between the via array of vias 221-223 and the via array of vias 224-225. In this embodiment, feed via 240 is disposed on a T-shape feed conductive part such as conductive part 242, where the feed conductive part is sandwiched between conductive sections 211-212. Feed via 240 extends or is drilled downwardly through substrates 701-702 to connect with a feeder circuit of RF frontend 101, through an opening such as opening 420 without contacting ground plane 703.

Figure 8A:
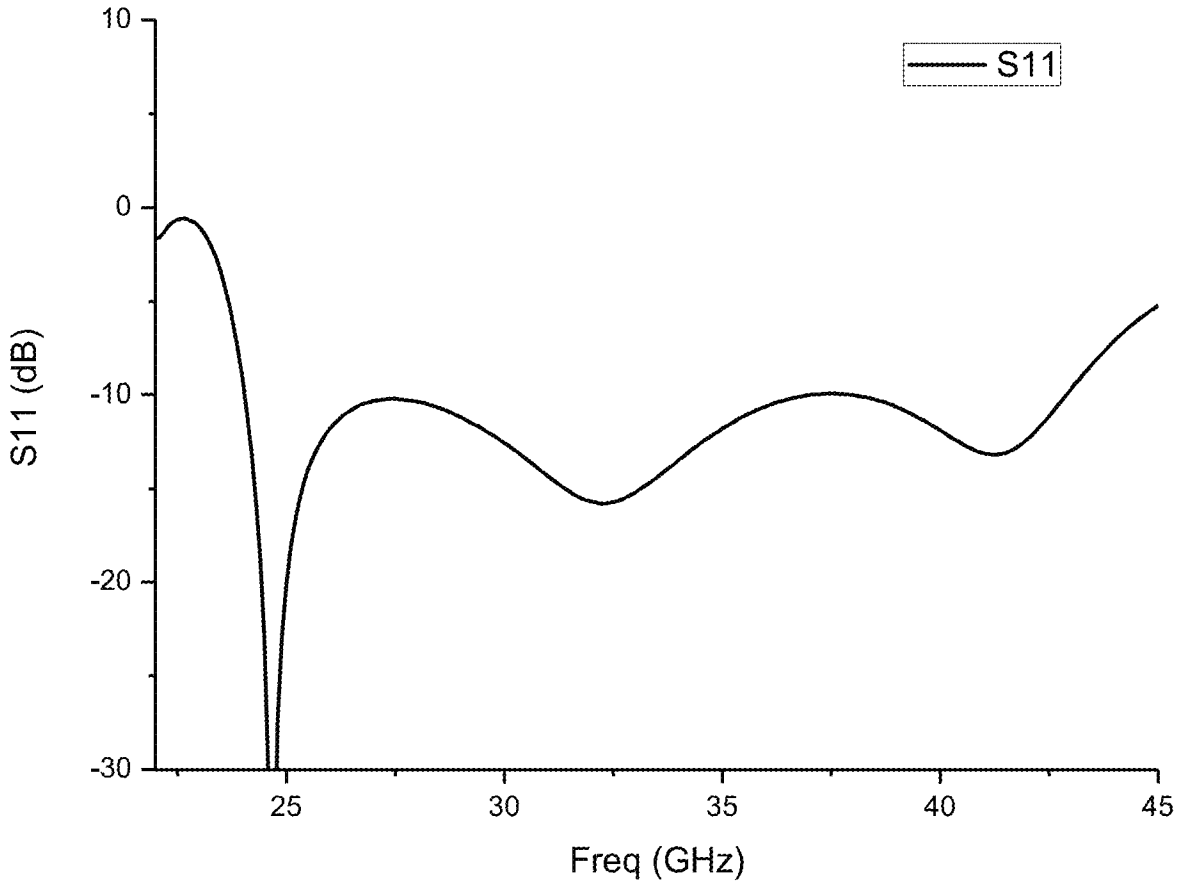
FIGS. 8A-8E illustrate certain simulation results of an RF antenna in different frequency bands according to some embodiments.
Figure 8B:
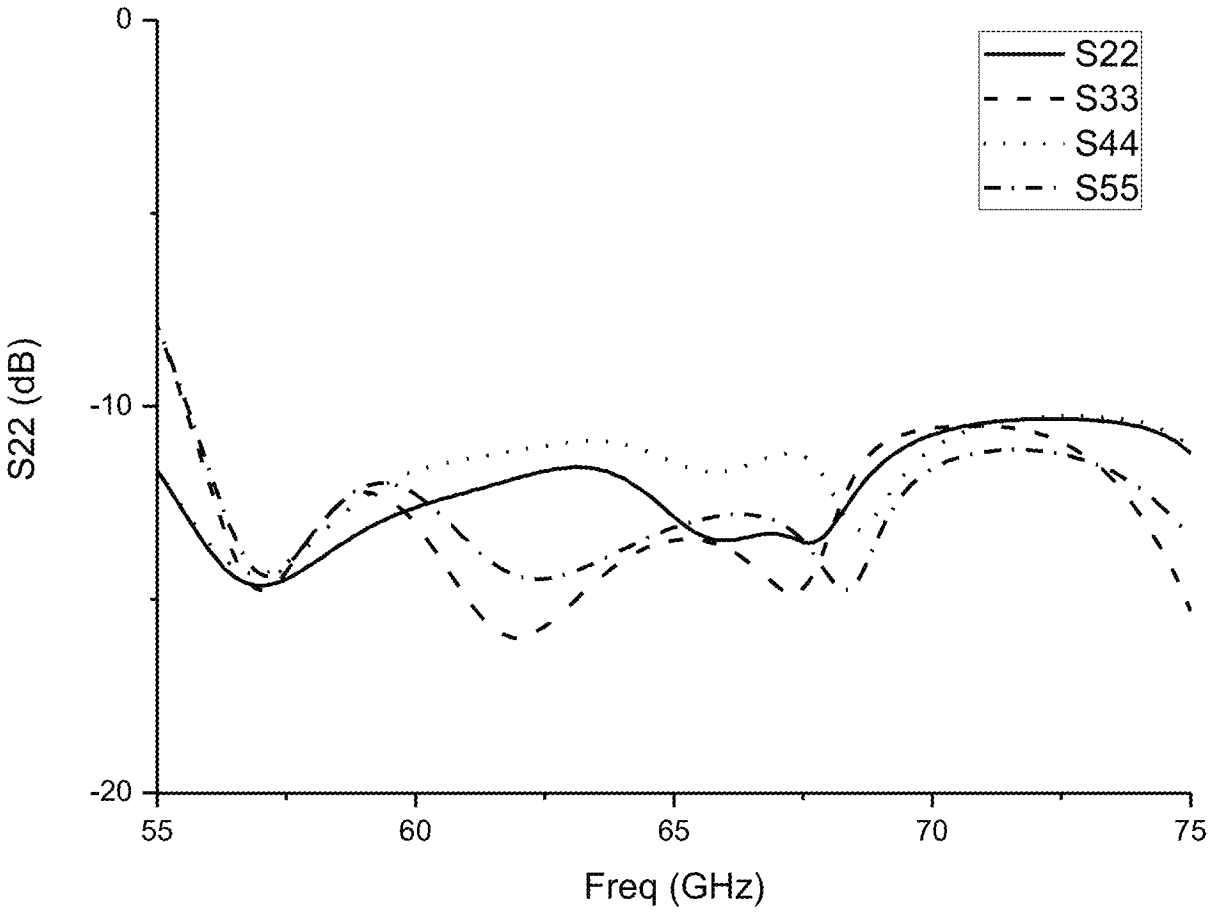
Figure 8C:
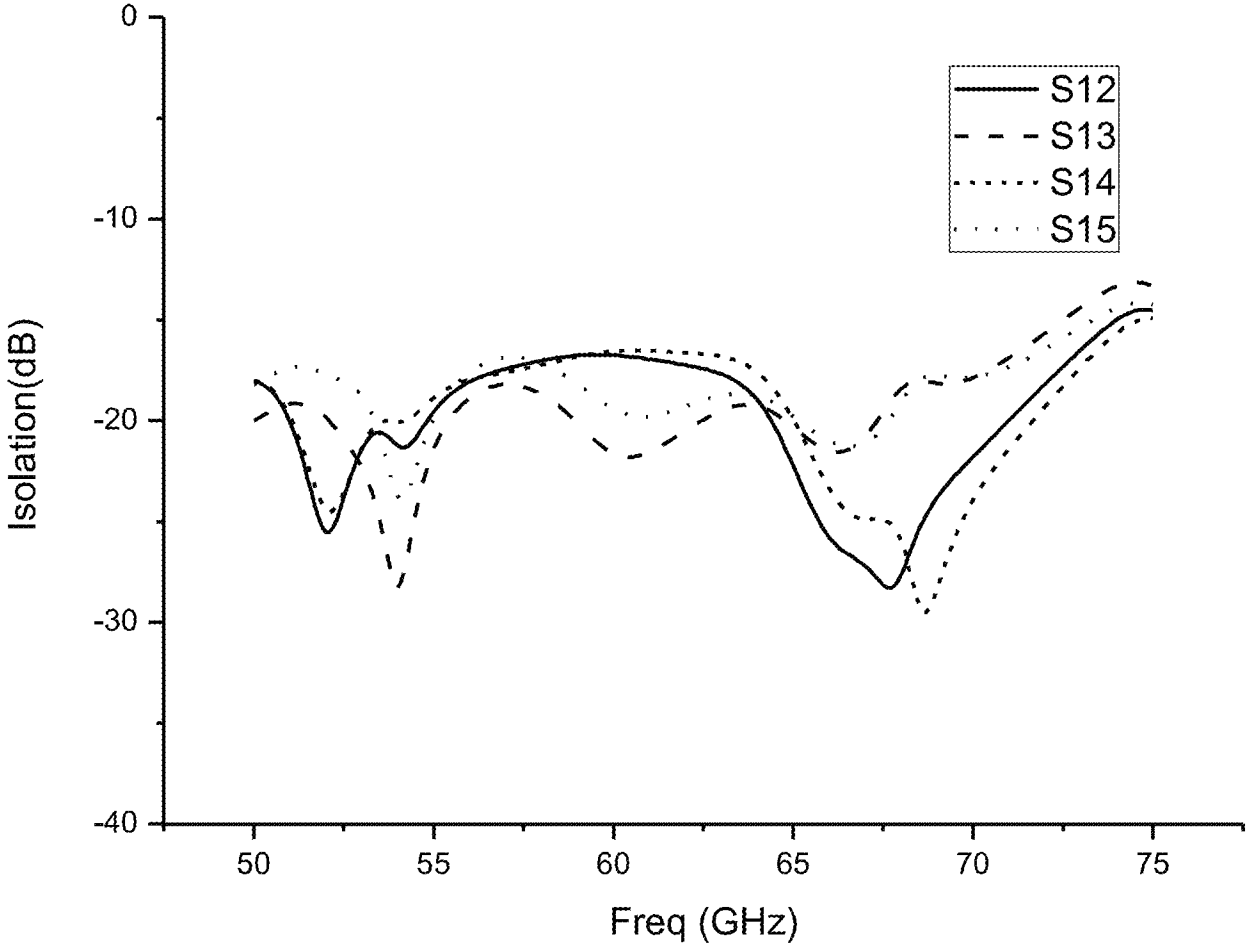
Figure 8D:
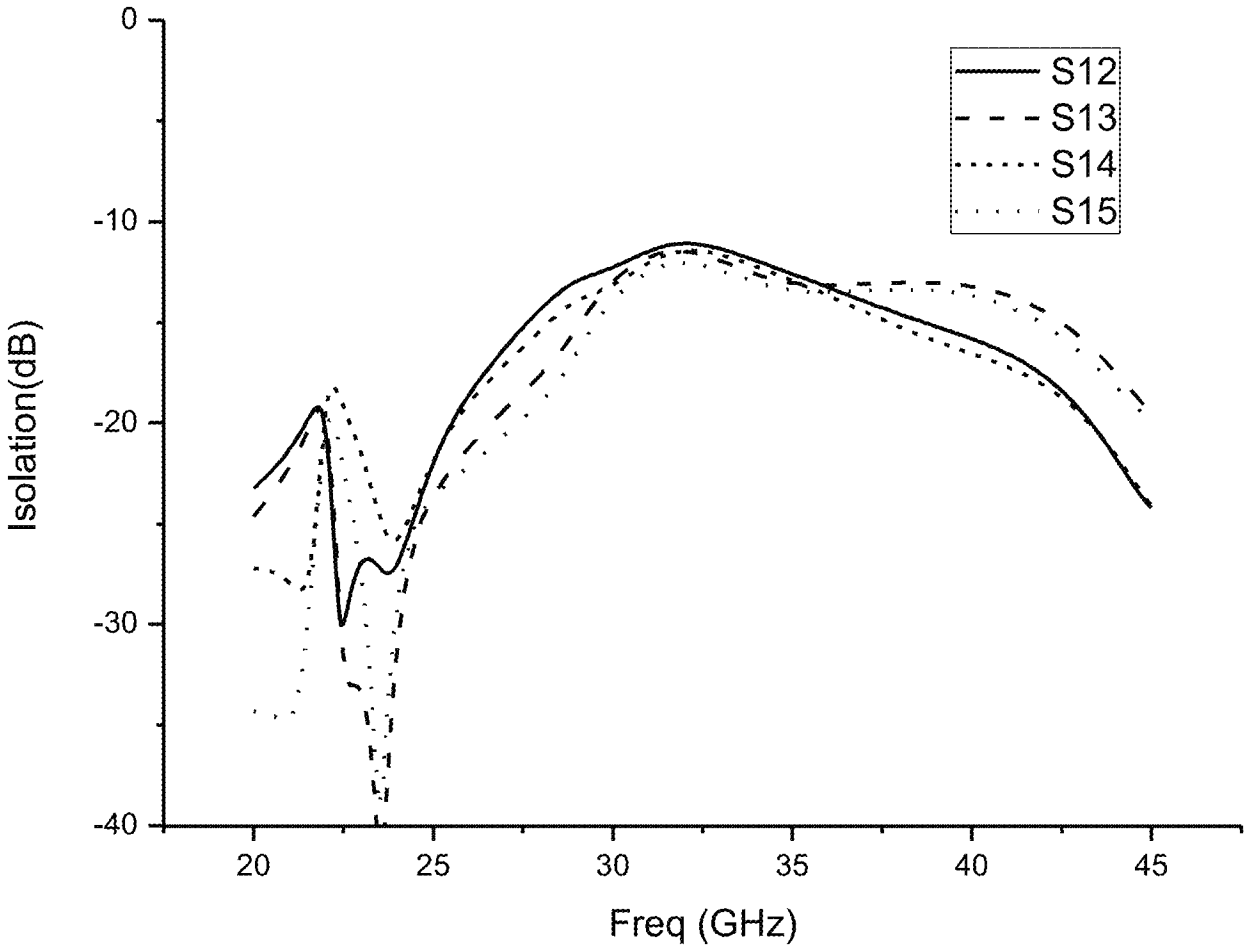
Figure 8E:
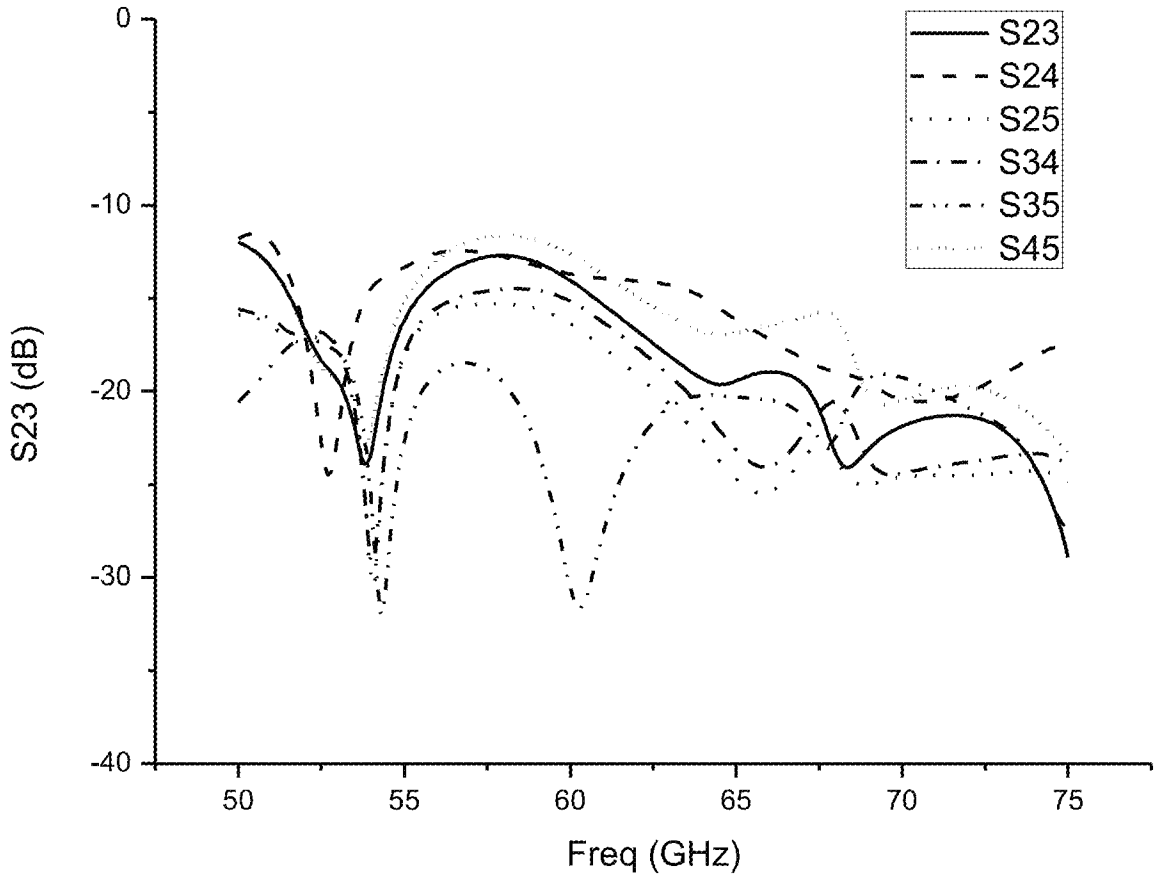
Figure 9A:
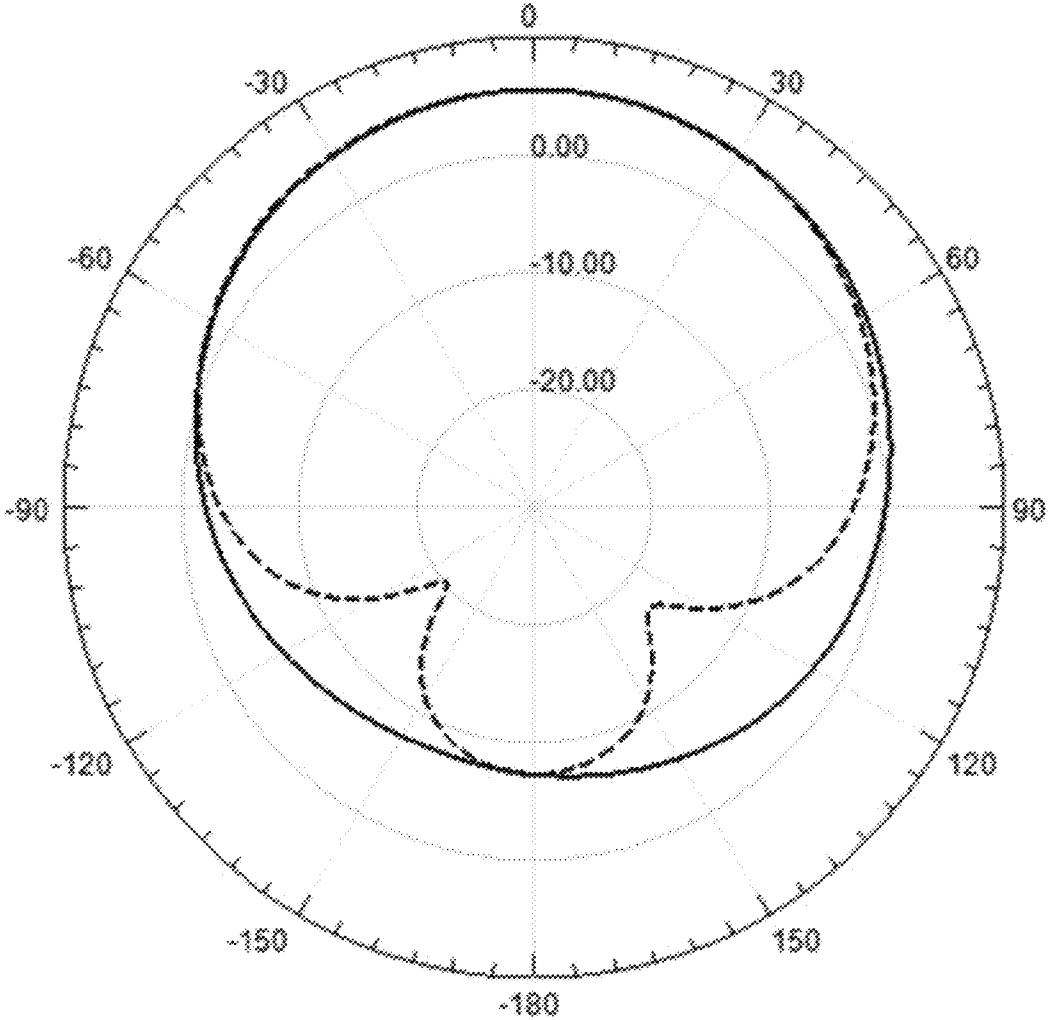
FIGS. 9A-9H illustrate the simulated radiation patterns of the antenna element structure for different frequency bands according to some embodiments.
Figure 9B:
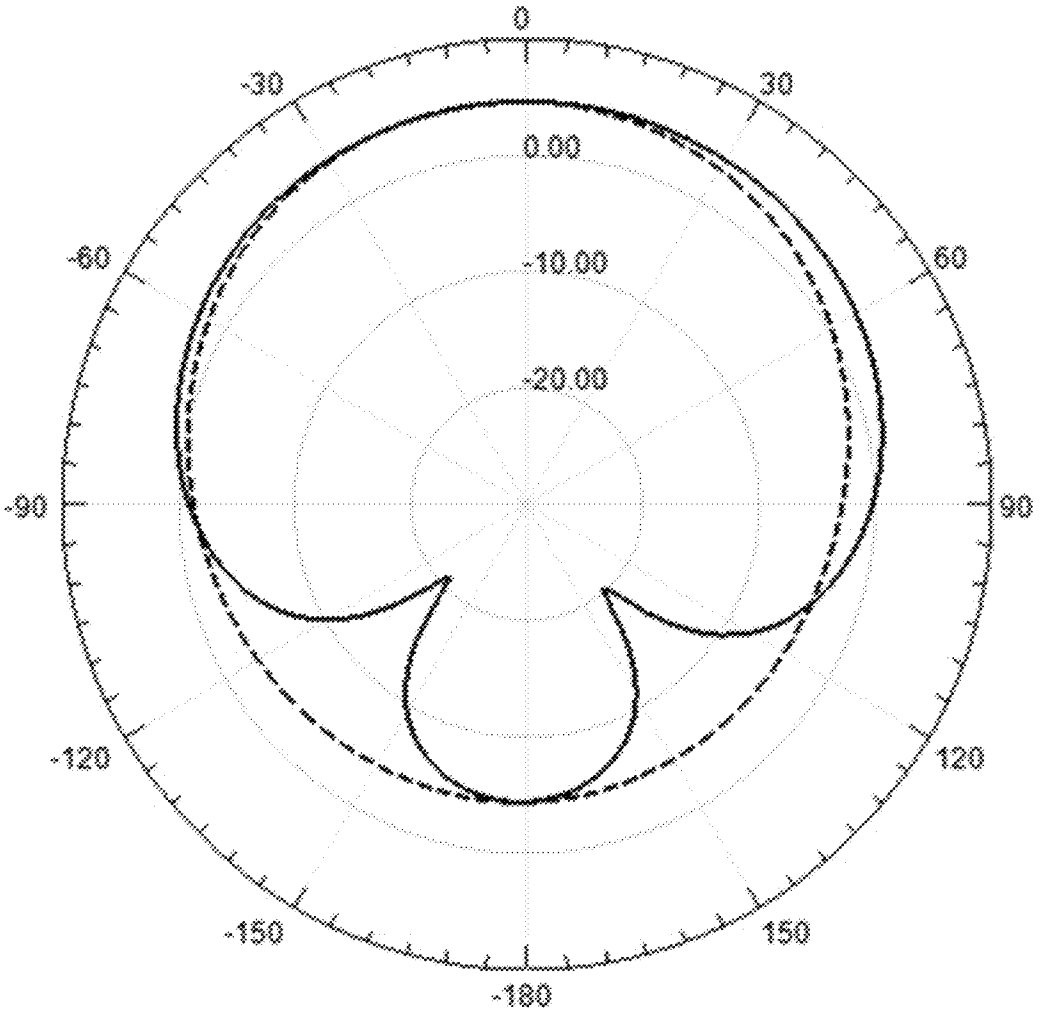
Figure 9C:
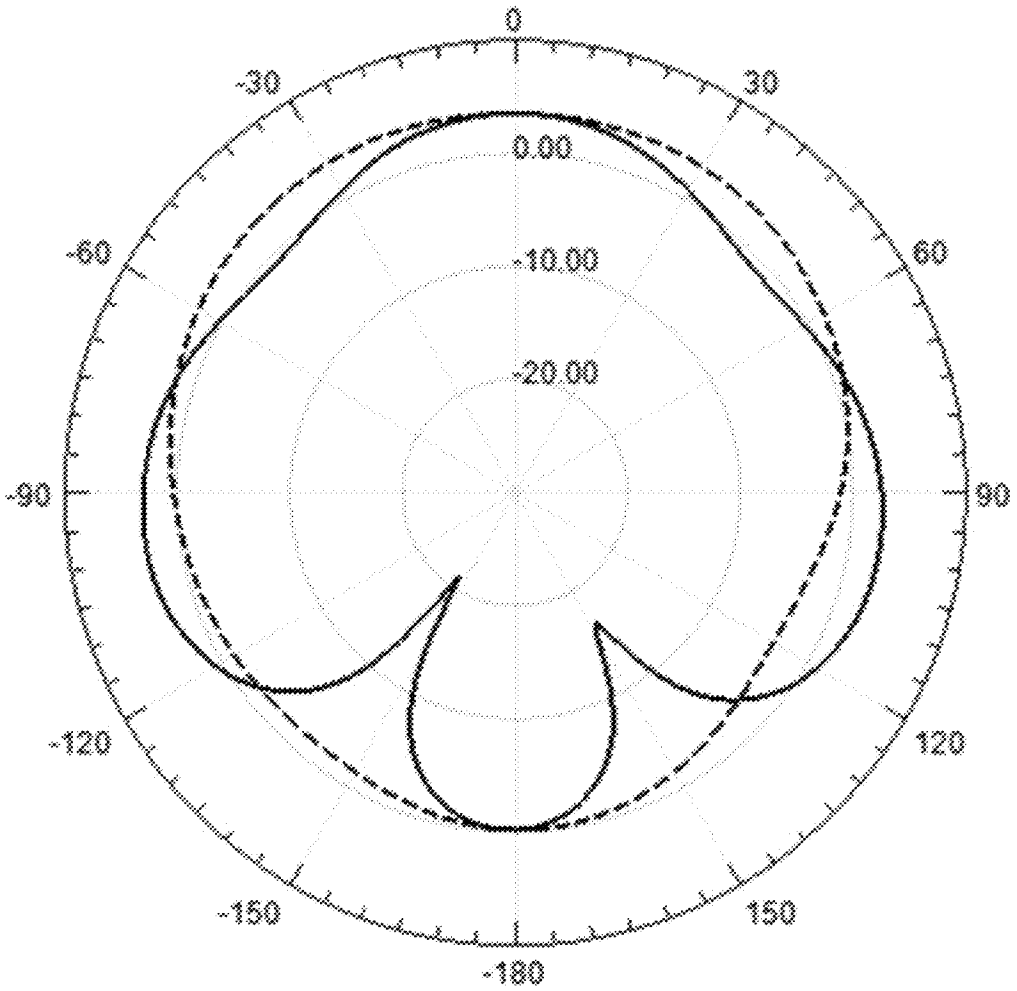
Figure 9D:
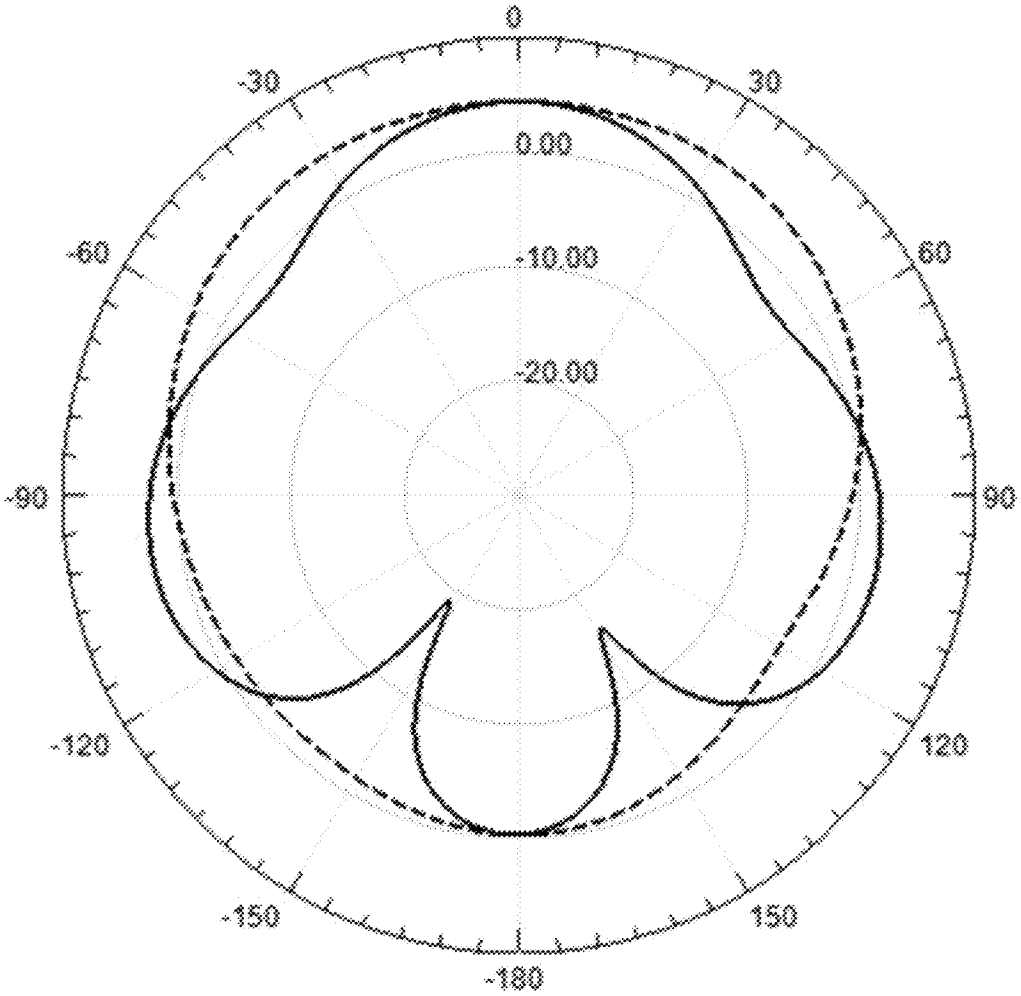
Figure 9E:
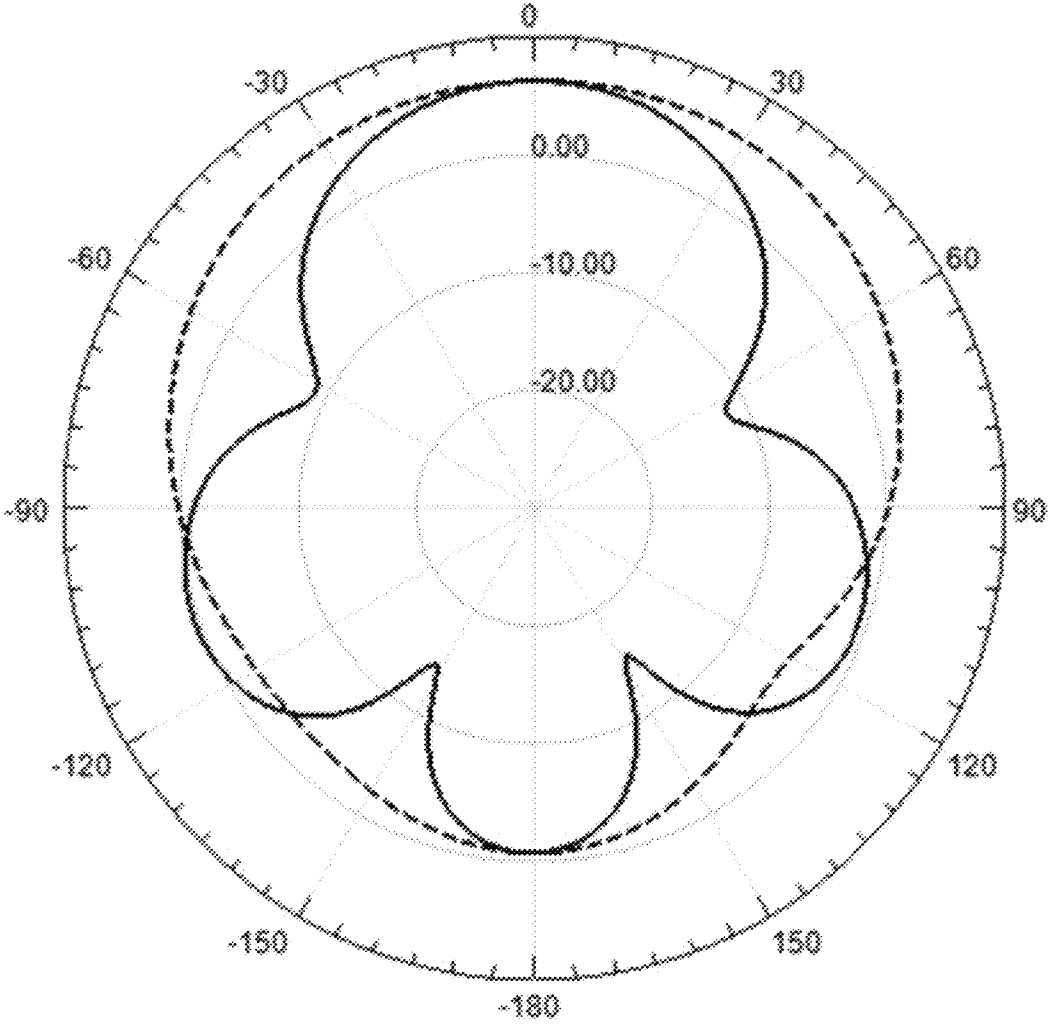
Figure 9F:
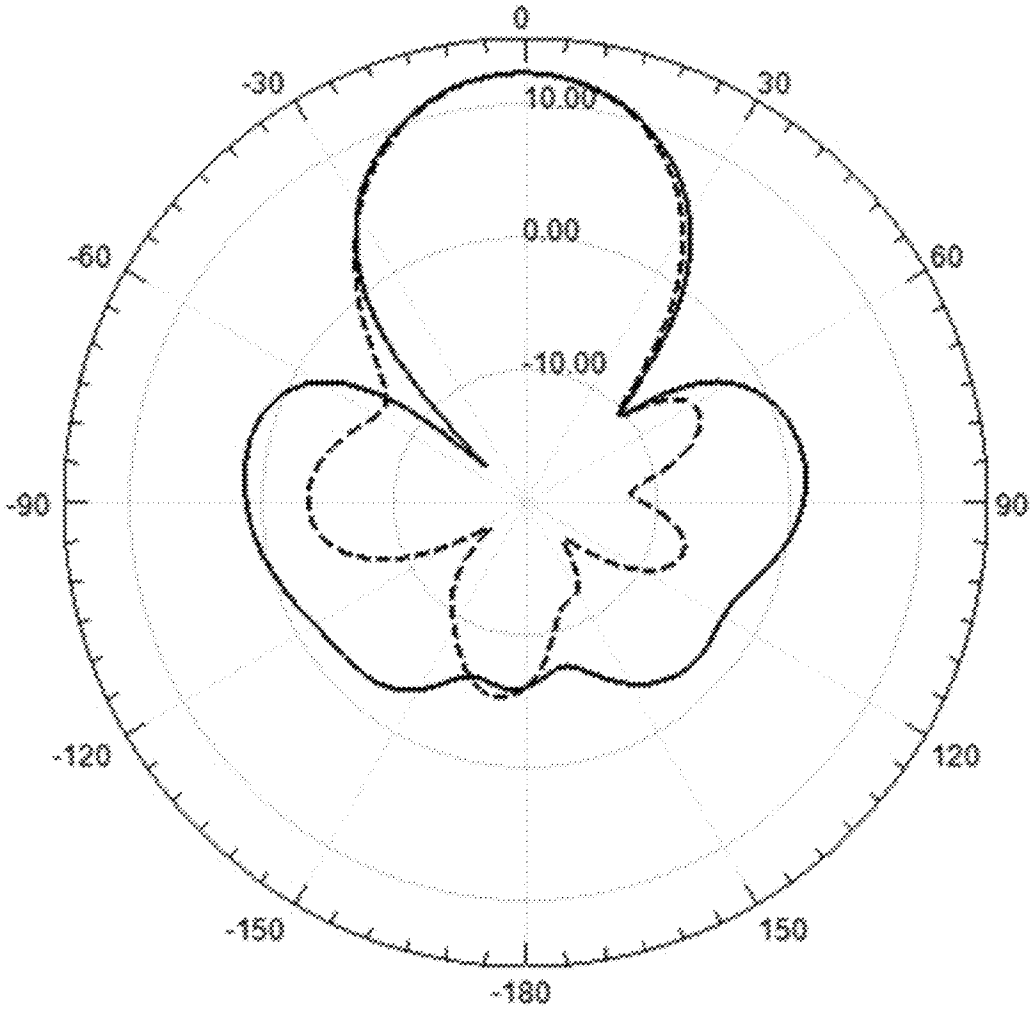
Figure 9G:
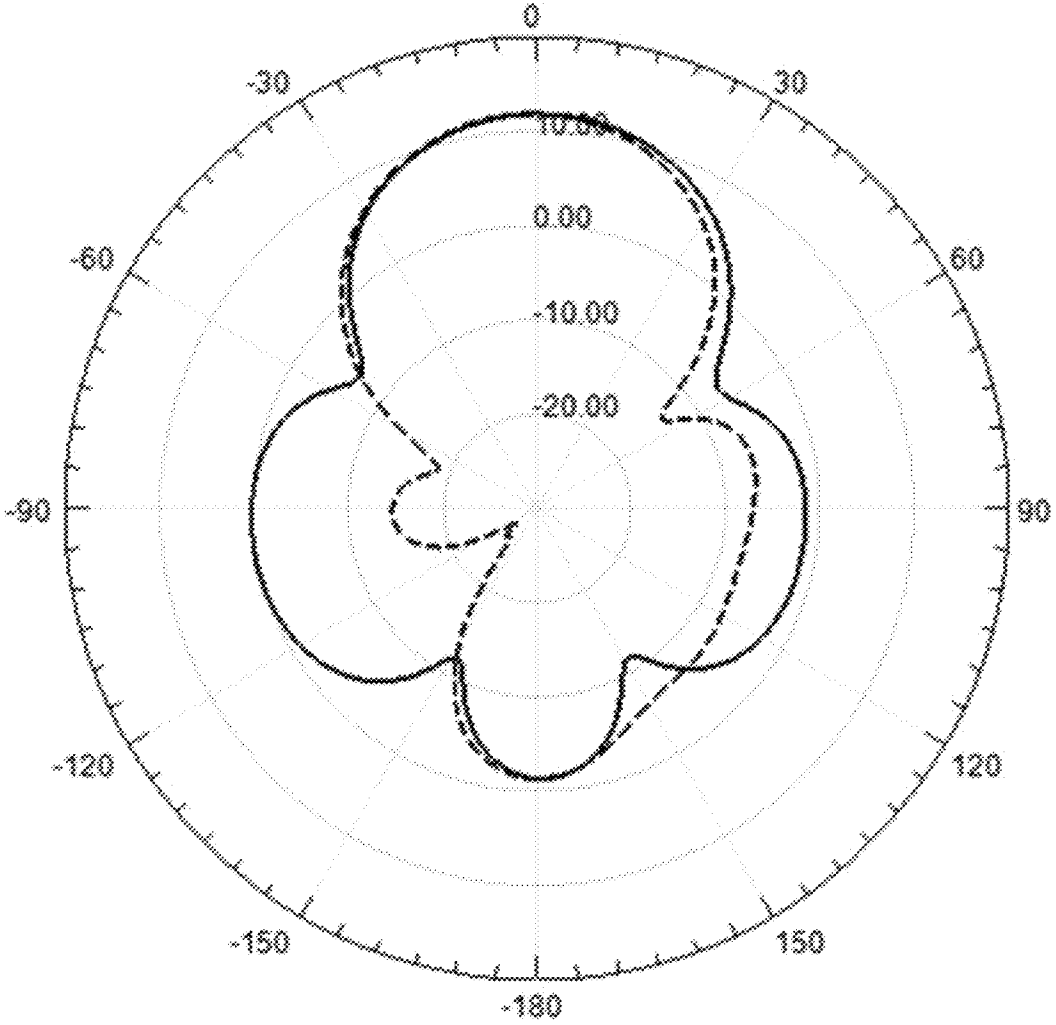
Figure 9H:
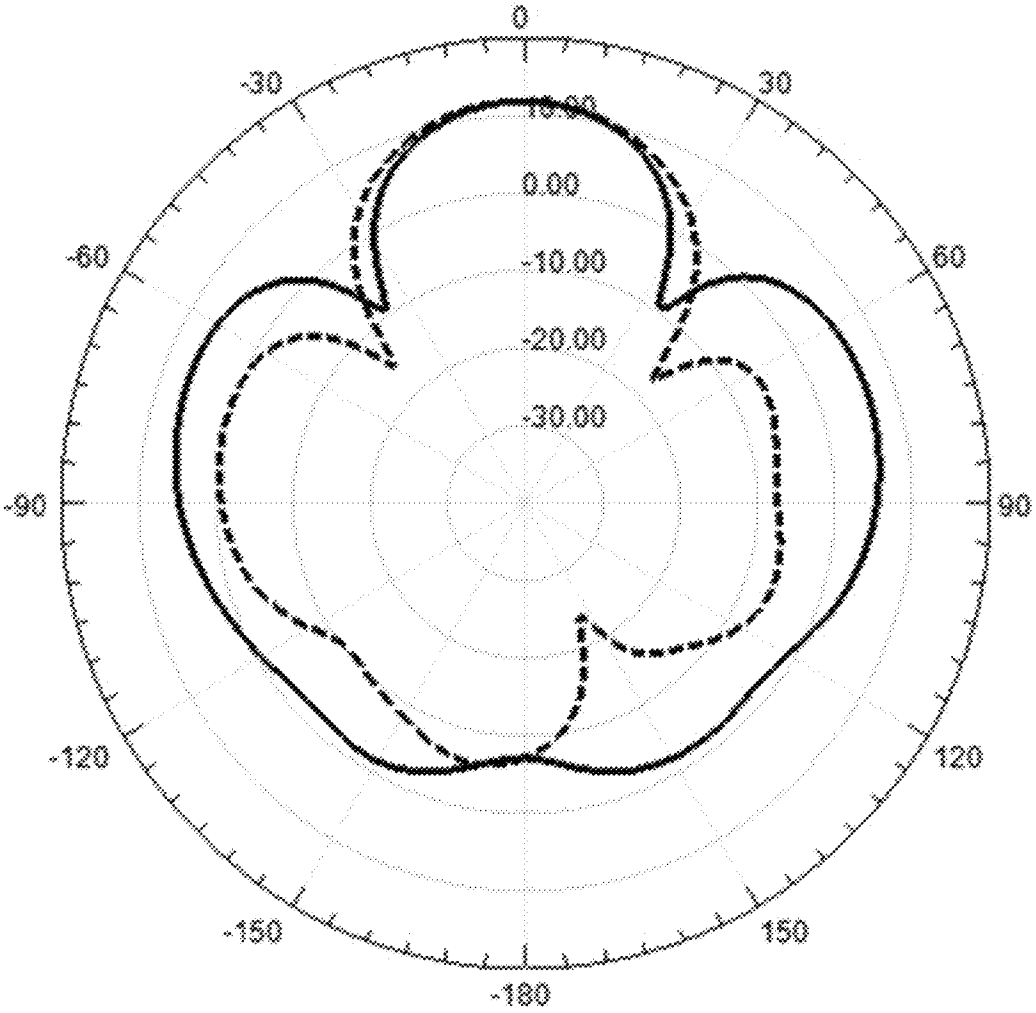

FIG. 8A illustrates a simulated return loss curve of the antenna element structure from 24 GHz to 43 GHz. FIG. 8B illustrates a simulated return loss curve of the antenna element structure from 59 GHz to 71 GHz. The S11 curve is the return loss curve of the low band radiation element 100, the S22, S33, S44, S55 curves are the return loss curves of the four high band radiation elements 200,201,202,203. FIG. 8C illustrates simulated isolation curves between the port of the high band magneto-electric dipole and the low band magneto-electric dipole from 24 GHz to 43 GHz. FIG. 8D illustrates simulated isolation curves between the port of the high band magneto-electric dipole and the port of the low band magneto-electric dipole from 59 GHz to 71 GHz. FIG. 8E illustrates simulated isolation curves between the ports of the high band magneto-electric dipoles from 59 GHz to 71 GHz. FIGS. 9A-9H illustrate the simulated radiation patterns of the antenna element structure operating at 24.75 GHz, 28 GHz, 37 GHz, 39 GHz, 42.5 GHz, 59 GHz, 65 GHz, and 71 GHz, respectively.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A radio frequency (RF) antenna, comprising:

a first substrate having a first top surface and a first bottom surface;

a second substrate having a second top surface and a second bottom surface, wherein the first substrate is disposed on top of the second substrate, the second bottom surface including a ground plane disposed thereon;

a low-band (LB) radiation element disposed on the first top surface of the first substrate, wherein the LB radiation element comprises a first electric dipole and a first magnetic dipole, wherein the first electric dipole comprises a first conductive section and a second conductive section, and wherein the LB radiation element is configured to resonate within a first frequency band to transmit and receive RF signals associated with the first frequency band; and a plurality of high-band (HB) radiation elements disposed between the first bottom surface of the first substrate and the second top surface of the second substrate, wherein each HB radiation element is configured to resonate within a second frequency band to transmit and receive RF signals associated with the second frequency band.

2. The RF antenna of claim 1, wherein each of the first and second conductive sections comprises a T-shape conductive element.

3. The RF antenna of claim 1, wherein the first magnetic dipole comprises a first via array connected with the first conductive section and a second via array connected with the second conductive section.

4. The RF antenna of claim 3, wherein the first via array and the second via array are aligned in parallel to each other.

5. The RF antenna of claim 3, wherein each via of the first and second via arrays extends through the first substrate, through the second substrate, and contacts with the ground plane disposed on the second bottom surface of the second substrate.

6. The RF antenna of claim 3, wherein the first conductive section further comprises a first feed via disposed between the first via array and the second via array, wherein the first feed via is to be coupled to a feeder circuit of an RF frontend circuit.

7. The RF antenna of claim 6, wherein the first feed via extends through the first substrate, through the second substrate, and through a first opening cut out from the ground plane, such that the first feed via does not contact with the ground plane.

8. A radio frequency (RF) antenna, comprising:

a first substrate having a first top surface and a first bottom surface;

a second substrate having a second top surface and a second bottom surface, wherein the first substrate is disposed on top of the second substrate, the second bottom surface including a ground plane disposed thereon;

a low-band (LB) radiation element disposed on the first top surface of the first substrate, wherein the LB radiation element is configured to resonate within a first frequency band to transmit and receive RF signals associated with the first frequency band; and a plurality of high-band (HB) radiation elements disposed between the first bottom surface of the first substrate and the second top surface of the second substrate, wherein each of the HB radiation elements comprises a second electric dipole and a second magnetic dipole, wherein the second electric dipole comprises a third conductive section and a fourth conductive section, and wherein each HB radiation element is configured to resonate within a second frequency band to transmit and receive RF signals associated with the second frequency band.

9. The RF antenna of claim 8, wherein the third conductive section is a U-shape conductive element and the fourth conductive section is a rectangular shape conductive element.

10. The RF antenna of claim 8, wherein the second magnetic dipole comprises a third via array connected with the third conductive section and a fourth via array connected with the fourth conductive section.

11. The RF antenna of claim 10, wherein the third via array and the fourth via array are aligned in parallel to each other.

12. The RF antenna of claim 10, wherein each via of the third and fourth via arrays extends through the first substrate, through the second substrate, and contacts with the ground plane disposed on the second bottom surface of the second substrate.

13. The RF antenna of claim 8, wherein each of the HB radiation elements further comprises a fifth conductive section having a second feed via extended through the first substrate, through the second substrate, and through a second opening cut out from the ground plane disposed on the second bottom surface of the second substrate, such that the second feed via does not contact with the ground plane.

14. The RF antenna of claim 13, wherein the fifth conductive section is disposed between the third conductive section and the fourth conductive section.

15. The RF antenna of claim 13, wherein the fifth conductive section is a T-shape conductive element.

16. A radio frequency (RF) frontend circuit, comprising:

one or more transceivers to transmit and receive RF signals within a plurality of frequency bands; and one or more RF antennas coupled to the transceivers, wherein each of the RF antennas includes a first substrate having a first top surface and a first bottom surface;

a second substrate having a second top surface and a second bottom surface, wherein the first substrate is disposed on top of the second substrate, the second bottom surface including a ground plane disposed thereon, a low-band (LB) radiation element disposed on the first top surface of the first substrate, each LB radiation element including a direct feed magneto electric dipole structure, wherein the LB radiation element is configured to resonate within a first frequency band to transmit and receive RF signals associated with the first frequency band, and wherein the LB radiation element comprises a first electric dipole and a first magnetic dipole, wherein the first electric dipole comprises a first conductive section and a second conductive section, and a plurality of high-band (HB) radiation elements disposed between the first bottom surface of the first substrate and the second top surface of the second substrate, each HB radiation element including a coupling feed magneto electric dipole structure, wherein each HB radiation element is configured to resonate within a second frequency band to transmit and receive RF signals associated with the second frequency band.

17. The RF frontend circuit of claim 16, wherein the plurality of HB radiation elements are disposed symmetrically with respect to the LB radiation element.

18. The RF frontend circuit of claim 16, wherein the second frequency band is higher than the first frequency band.

* * * * *